US006724359B2

(12) United States Patent
Yamamoto et al.

(10) Patent No.: US 6,724,359 B2
(45) Date of Patent: Apr. 20, 2004

(54) ELECTRONIC DEVICE AND METHOD FOR DRIVING THE SAME

(75) Inventors: Tomohiko Yamamoto, Nara (JP); Keiichi Tanaka, Nara (JP); Hideki Ichioka, Mie (JP); Naoto Inoue, Nara (JP); Koji Fujiwara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 151 days.

(21) Appl. No.: 10/027,114

(22) Filed: Dec. 20, 2001

(65) Prior Publication Data

US 2002/0089813 A1 Jul. 11, 2002

(30) Foreign Application Priority Data

Jan. 9, 2001 (JP) ..... 2001-001754
Nov. 16, 2001 (JP) ..... 2001-351093

(51) Int. Cl.[7] ..... G09G 3/36

(52) U.S. Cl. ..... 345/92; 345/90; 345/204; 349/48

(58) Field of Search ..... 345/87–103, 204; 349/41–48; 361/327, 328

(56) References Cited

U.S. PATENT DOCUMENTS 6,181,311 B1 * 1/2001 Hashimoto ..... 345/98
6,225,750 B1 * 5/2001 Kimura ..... 315/169.3
6,621,477 B1 * 9/2003 Inoue et al. ..... 345/92

FOREIGN PATENT DOCUMENTS

JP 2000-10065 A 1/2001

* cited by examiner

*Primary Examiner*—Lun-Yi Lao
(74) *Attorney, Agent, or Firm*—David G. Conlin; William J. Daley, Jr.; Edwards & Angell, LLP

(57) ABSTRACT

An electronic device includes on a substrate: a plurality of first capacitors each including a first electrode and a second electrode opposing the first electrode via a first dielectric layer; a plurality of second capacitors each including a third electrode electrically connected to the first electrode and a fourth electrode opposing the third electrode via a second dielectric layer; a first line whose electrical connection to the first electrode and the third electrode is turned ON/OFF by a first switching element; a second line electrically connected to the second electrode at least temporarily; a third line whose electrical connection to the fourth electrode is turned ON/OFF by a second switching element; and a fourth line whose electrical connection to the fourth electrode is turned ON/OFF by a third switching element.

16 Claims, 18 Drawing Sheets

ELECTRONIC DEVICE AND METHOD FOR DRIVING THE SAME

BACKGROUND OF THE INVENTION

1. Field of the Invention

The present invention relates to an electronic device and a method for driving the same.

2. Description of the Background Art

In recent years, flat display panels have been used as display devices in a display unit of a notebook computer, a portable telephone, or a personal digital assistant (PDA). Many of such flat display panels are liquid crystal display devices. Since the power consumption is one of the factors that determine the product value of these portable devices, there is a demand for reducing the power consumption of a liquid crystal display device used in a display unit. Particularly, there is a demand for reducing the power consumption of the liquid crystal module itself in order to further reduce the power consumption of a reflection type liquid crystal display device that has no backlight.

Typically, the power consumption Pw of an electronic device including many capacitors such as a liquid crystal display device is expressed as $Pw=C\cdot f\cdot V^2$ based on a linear approximation, where C denotes the capacitance, f denotes the frequency, and V denotes the voltage. Therefore, the power consumption Pw can be reduced by reducing the capacitance C, the frequency f or the voltage V. Particularly, it is effective in reducing the power consumption to operate the device with a reduced voltage V because the power consumption Pw is proportional to the square of the voltage V as shown in the expression above, and because a voltage loss occurs when increasing the voltage supplied from the system (e.g., about 3.3 V in the case of a notebook computer).

In the prior art, the driving voltage of a liquid crystal display device has been reduced by reducing the threshold voltage of a liquid crystal layer, or setting the voltage for a gray level that requires the highest voltage to be lower than the normal voltage therefor, so as to narrow the dynamic range of the driving voltage.

However, such a low voltage driving operation has the following problems.

First, when using a liquid crystal material having a large (specific) dielectric anisotropy $\Delta\epsilon(=\epsilon//-\epsilon\perp)$ in order to reduce the threshold voltage of the liquid crystal layer, the signal voltage dependence of a feed through voltage increases, whereby it is necessary to make a correction according to the magnitude of the signal voltage. When a liquid crystal material having a large (specific) dielectric anisotropy $\epsilon//$ in the long axis direction of liquid crystal molecules is used as a liquid crystal material having a large (specific) dielectric anisotropy $\Delta\epsilon$, the liquid crystal capacitance is large, thereby increasing the size of TFTs (thin film transistors) for charging and increasing the load capacitance of the liquid crystal panel. Moreover, since the average dielectric constant of such a liquid crystal material is large, an impurity in the liquid crystal layer is easily ionized. Therefore, such a liquid crystal material undergoes a significant aging deterioration in terms of resistance, and thus cannot be used in a liquid crystal display device that is to be used under severe environments.

When the voltage for a gray level that requires the highest voltage is set to be lower than the normal voltage therefor, the contrast ratio is reduced, thereby reducing the display quality. Particularly, a liquid crystal display device that displays images in a normally white mode undergoes a significant reduction in the contrast ratio and thus a significant reduction in the display quality.

SUMMARY OF THE INVENTION

The present invention has been made in view of these problems, and has an object to provide an electronic device capable of operating with a low voltage and a method for driving the same.

An electronic device of the present invention includes on a substrate: a plurality of first capacitors arranged in a matrix pattern having rows and columns, each of the first capacitors including a first electrode and a second electrode opposing the first electrode via a first dielectric layer; a plurality of second capacitors provided so that there is one second capacitor at least for each row or each column, each of the second capacitors including a third electrode electrically connected to the first electrode and a fourth electrode opposing the third electrode via a second dielectric layer; a first line whose electrical connection to the first electrode and the third electrode is turned ON/OFF by a first switching element; a second line electrically connected to the second electrode at least temporarily; a third line whose electrical connection to the fourth electrode is turned ON/OFF by a second switching element; and a fourth line whose electrical connection to the fourth electrode is turned ON/OFF by a third switching element. Thus, the above object is realized.

In one embodiment of the invention: each of the plurality of first capacitors is a liquid crystal capacitor including the first electrode as a pixel electrode, the first dielectric layer as a liquid crystal layer, and the second electrode as a counter electrode opposing the pixel electrode via the liquid crystal layer; each of the plurality of second capacitors is a storage capacitor including the third electrode as a storage capacitor electrode, the second dielectric layer, and the fourth electrode as a storage capacitor counter electrode opposing the storage capacitor electrode via the second dielectric layer; and the liquid crystal layer modulates light passing therethrough according to a voltage applied between the pixel electrode and the counter electrode.

Preferably, the storage capacitor is provided so as to correspond to the liquid crystal capacitor. In one embodiment of the electronic device where the storage capacitor is provided so as to correspond to the liquid crystal capacitor, the first line is provided for each row or each column and functions also as the third line so as to supply a signal voltage to the pixel electrode, the storage capacitor electrode and the storage capacitor counter electrode, and the second line is provided for each row or each column and functions also as the fourth line so as to supply a counter voltage to the counter electrode and the storage capacitor counter electrode.

In one embodiment of the invention, the first line is provided for each row or each column and functions also as the third line so as to supply a signal voltage to the pixel electrode, the storage capacitor electrode and the storage capacitor counter electrode, the second line supplies a counter voltage to the counter electrode, the fourth line supplies the same voltage as the counter voltage to the storage capacitor counter electrode, and the storage capacitor is provided so as to correspond to the first line.

In one embodiment of the invention, the electronic device further includes a plurality of scanning lines provided so as to cross the first line for supplying a scanning signal to the first switching element, the second switching element and the third switching element.

Preferably, every adjacent two of the plurality of scanning lines form a scanning line pair, one of the two scanning lines, which form the scanning line pair, supplying a scanning signal to the first switching element and the third switching element with the other one supplying a scanning signal to the second switching element.

Preferably, the electronic device further includes a plurality of additional storage capacitors provided so as to correspond respectively to the plurality of liquid crystal capacitors, each of the additional storage capacitors including an additional storage capacitor electrode electrically connected to the pixel electrode and an additional storage capacitor counter electrode opposing the additional storage capacitor electrode via a third dielectric layer, wherein the third dielectric layer is formed from the same film as the second dielectric layer.

Preferably, the second switching element and the third switching element are transistors of different conductivity types.

A method of the present invention is a method for driving an electronic device, the electronic device including on a substrate: a plurality of first capacitors arranged in a matrix pattern having rows and columns, each of the first capacitors including a first electrode and a second electrode opposing the first electrode via a first dielectric layer; and a plurality of second capacitors provided so that there is one second capacitor at least for each row or each column, each of the second capacitors including a third electrode and a fourth electrode opposing the third electrode via a second dielectric layer, the method including the step of: switching a state where the first capacitor and the second capacitor are electrically connected in parallel to each other and another state where the first capacitor and the second capacitor are electrically connected in series with each other from one to another, thereby increasing a voltage being applied between the first electrode and the second electrode. Thus, the above object is realized.

Preferably, the voltage increasing step further includes the steps of: in the state where the first capacitor and the second capacitor are electrically connected in parallel to each other, applying a predetermined first potential to the first electrode and the third electrode while applying a predetermined second potential, which is different from the predetermined first potential, to the second electrode and the fourth electrode, so as to apply a predetermined voltage between the first electrode and the second electrode and between the third electrode and the fourth electrode, thus charging the first capacitor and the second capacitor; after charging the first capacitor and the second capacitor, achieving a state where the first electrode and the third electrode are electrically connected to each other and the first capacitor and the second capacitor are electrically connected in series with each other, while applying the predetermined second potential to the second electrode and applying the predetermined first potential to the fourth electrode, so as to increase the predetermined voltage applied between the first electrode and the second electrode; and after increasing the predetermined voltage, achieving a state where at least one of the second electrode and the fourth electrode is electrically cut off, whereby the increased voltage is held by the first capacitor.

In one embodiment of the invention: each of the plurality of first capacitors is a liquid crystal capacitor including the first electrode as a pixel electrode, the first dielectric layer as a liquid crystal layer, and the second electrode as a counter electrode opposing the pixel electrode via the liquid crystal layer; each of the plurality of second capacitors is a storage capacitor including the third electrode as a storage capacitor electrode, the second dielectric layer, and the fourth electrode as a storage capacitor counter electrode opposing the storage capacitor electrode via the second dielectric layer; and the liquid crystal layer modulates light passing therethrough according to a voltage applied between the pixel electrode and the counter electrode.

Preferably, the storage capacitor is provided so as to correspond to the liquid crystal capacitor.

In one embodiment of the invention, the storage capacitor is provided for each row or each column.

DETAILED DESCRIPTION OF THE INVENTION

Various embodiments of the present invention will now be described with reference to the drawings. An electronic device and a method for driving an electronic device according to the present invention provide a desirable reduction in the power consumption. Therefore, the present invention can suitably be applied to an active matrix type liquid crystal display device, for example. Although embodiments of the present invention will be described below with respect to an active matrix type liquid crystal display device employing TFTS (thin film transistors), the present invention is not limited thereto but can be applied widely to electronic devices in general.

EMBODIMENT 1

Figure 1:
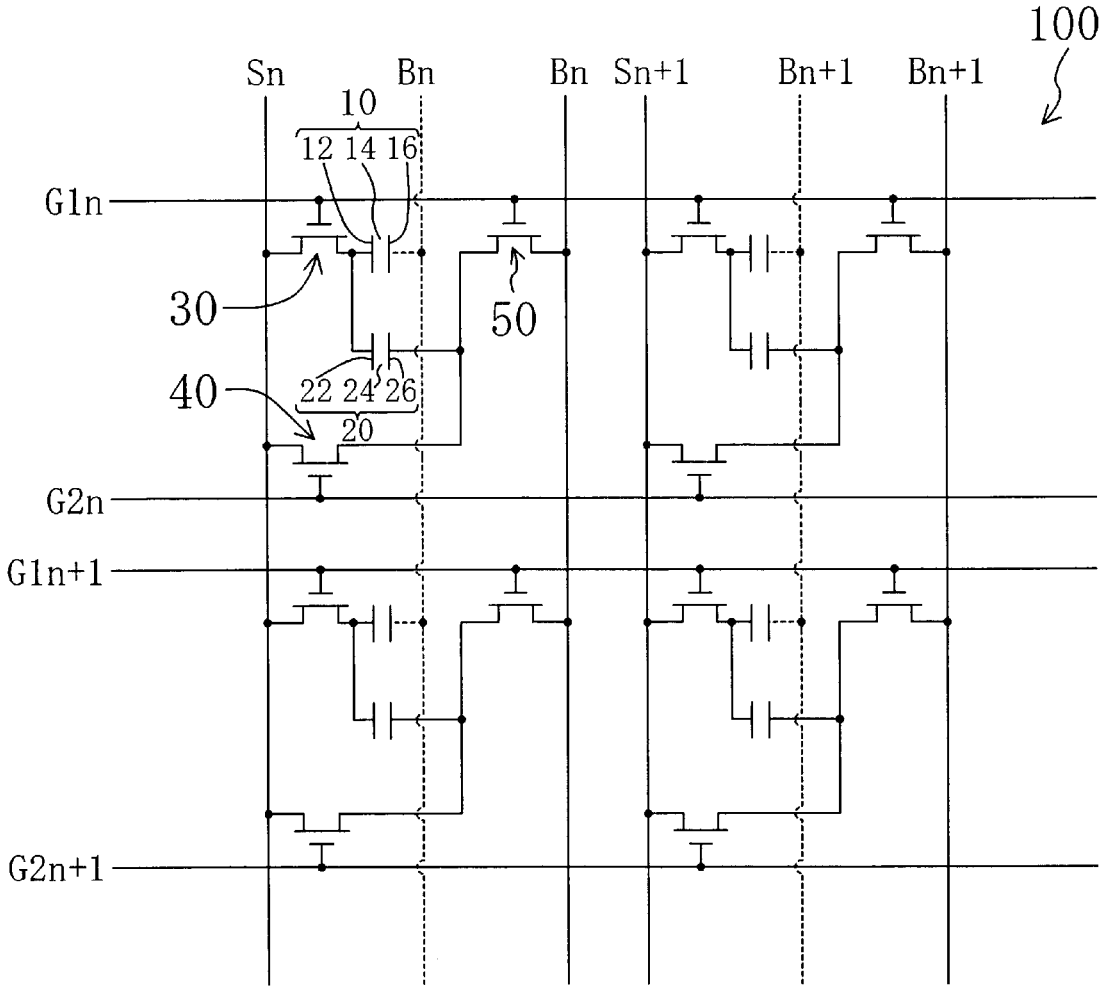
FIG. 1 is a diagram illustrating an equivalent circuit of a liquid crystal display device 100, which is an electronic device according to Embodiment 1 of the present invention.

A liquid crystal display device 100, which is an electronic device according to Embodiment 1 of the present invention, will now be described with reference to FIG. 1. FIG. 1 is a diagram illustrating an equivalent circuit of the liquid crystal display device 100. As illustrated in FIG. 1, the liquid crystal display device 100 includes a plurality of liquid crystal capacitors 10 arranged in a matrix pattern having rows and columns, and a plurality of storage capacitors 20 corresponding respectively to the plurality of liquid crystal capacitors 10. Note that FIG. 1 only shows pixels of two rows and two columns (pixels at nth row-nth column, $n^{th}$ row-$n+1^{th}$ column, $n+1^{th}$ row-$n^{th}$ column and $n+1^{th}$ row-$n+1^{th}$ column) among a plurality of pixels respectively including the plurality of liquid crystal capacitors 10 arranged in a matrix pattern.

Each of the plurality of liquid crystal capacitors 10 includes a pixel electrode 12, a counter electrode 16 opposing the pixel electrode 12, and a liquid crystal layer 14 provided between the pixel electrode 12 and the counter electrode 16. The liquid crystal layer 14 modulates light passing therethrough according to the voltage applied between the pixel electrode 12 and the counter electrode 16. Each of the plurality of storage capacitors 20 includes a storage capacitor electrode 22 electrically connected to the pixel electrode 12, a storage capacitor counter electrode 26 opposing the storage capacitor electrode 22, and a gate insulating film 24 provided between the storage capacitor electrode 22 and the storage capacitor counter electrode 26.

The liquid crystal display device 100 further includes a signal line Si (also called "source line"; the designation Si denotes a signal line provided in the $i^{th}$ column; signal lines Sn and Sn+1 that are provided in the $n^{th}$ and $n+1^{th}$ columns, respectively, will be shown in the subsequent figures) provided for each column, and a reference line Bi (the designation Bi denotes a reference line provided in the $i^{th}$ column; reference lines Bn and Bn+1 that are provided in the $n^{th}$ and $n+1^{th}$ columns, respectively, will be shown in the subsequent figures) provided for each column. The signal line Si supplies a signal voltage to the pixel electrode 12 and the storage capacitor electrode 22, and the reference line Bi supplies a counter voltage (reference voltage) to the counter electrode 16 and the storage capacitor counter electrode 26. The electrical connection of the signal line Si to the pixel electrode 12 and storage capacitor electrode 22 is turned ON/OFF by a first TFT 30. Note however that in the liquid crystal display device 100 of the present embodiment, not only a counter voltage (reference voltage) but also a signal voltage is supplied to the storage capacitor counter electrode 26. The electrical connection between the signal line Si and the storage capacitor counter electrode 26 is turned ON/OFF by a second TFT 40, and that between the reference line Bi and the storage capacitor counter electrode 26 is turned ON/OFF by a third TFT 50.

The liquid crystal display device 100 further includes a plurality of scanning lines (also called "gate lines"), provided so as to cross the signal line Si, for supplying a scanning signal to the first TFT 30, the second TFT 40 and the third TFT 50. The plurality of scanning lines include scanning line pairs each including two adjacent scanning lines G1*i* and G2*i*. The scanning line G1*i* supplies a scanning signal to the first TFT 30 and the third TFT 50, and the scanning line G2*i* supplies a scanning signal to the second TFT 40 (the designations G1*i* denotes one of the two scanning lines forming a scanning line pair provided in the $i^{th}$ row, and G2*i* denotes the other one of the two scanning lines; scanning lines G1*n* and G2*n* provided in the $n^{th}$ row and scanning lines G1*n*+1 and G2*n*+1 provided in the $n+1^{th}$ row will be shown in the subsequent figures).

Figure 2:
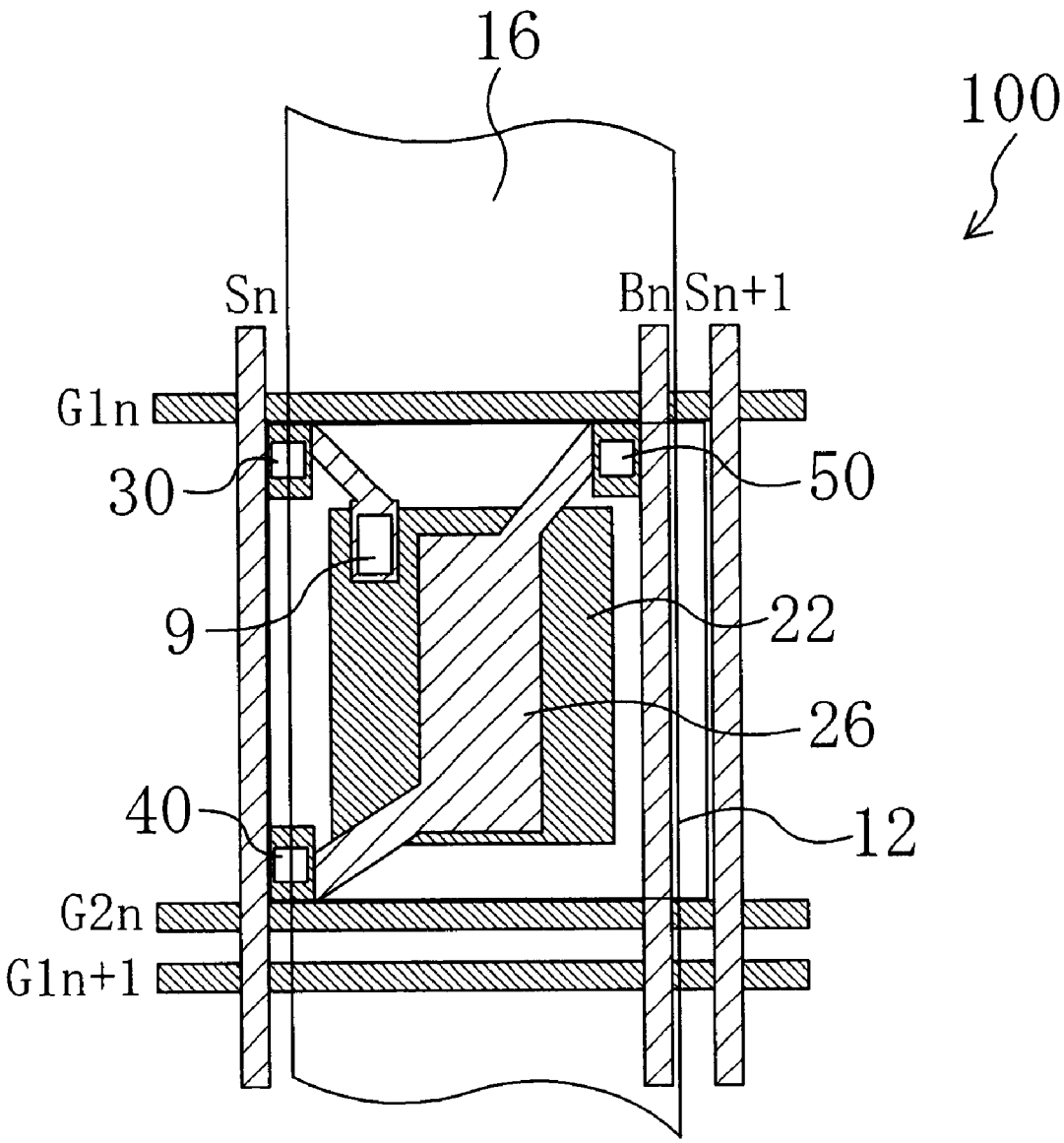
FIG. 2 is a top view schematically illustrating a portion of the liquid crystal display device 100, which is an electronic device according to Embodiment 1 of the present invention, corresponding to one pixel.

Next, the configuration of the liquid crystal display device 100 will be described in greater detail with reference to FIG. 2. FIG. 2 is a top view schematically illustrating a portion of the liquid crystal display device 100 corresponding to one pixel. The liquid crystal display device 100 includes a TFT substrate (not shown), a counter substrate (not shown) and a liquid crystal layer 14 (not shown in FIG. 2) provided between the TFT substrate and the counter substrate.

The TFT substrate of the liquid crystal display device 100 includes: an insulative substrate (e.g., a glass substrate; not shown); the first TFT 30, the second TFT 40 and the third TFT 50 formed on the insulative substrate; and the scanning lines G1*i* and G2*i*, the signal line Si and the reference line Bi connected to the first TFT 30, the second TFT 40 and the third TFT 50. The TFT substrate further includes the pixel electrode 12, the storage capacitor electrode 22 and the storage capacitor counter electrode 26.

The gate electrodes (not shown) of the first TFT 30, the second TFT 40 and the third TFT 50, the scanning lines G1*i* and G2*i* and the storage capacitor electrode 22 are formed by patterning the same metal layer (e.g., a tantalum layer). Of course, a layered structure including another conductive layer (e.g., a tantalum nitride layer) may alternatively be employed.

Typically, the gate insulating film (e.g., a silicon nitride layer; not shown in FIG. 2) 24 is formed substantially across the entire surface of the TFT substrate so as to cover the gate electrodes of the first TFT 30, the second TFT 40 and the third TFT 50, the scanning lines G1*i* and G2*i* and the storage capacitor electrode 22. Provided on the gate insulating film 24 are: a semiconductor layer (not shown), a source electrode (not shown) and a drain electrode (not shown) forming the first TFT 30, the second TFT 40 and the third TFT 50; the signal line Si; and the storage capacitor counter electrode 26. The source electrode, the drain electrode, the signal line Si and the storage capacitor counter electrode 26 are formed by patterning the same metal layer (e.g., a tantalum layer). Of course, a layered structure including another conductive layer (e.g., an ITO layer) may alternatively be employed.

The storage capacitor electrode 22 is electrically connected to the drain electrode of the first TFT 30 at a contact hole 9 formed in the gate insulating film 24. The storage capacitor counter electrode 26 is electrically connected to the drain electrodes of the second TFT 40 and the third TFT 50.

An insulative layer (e.g., a resin layer; not shown) is formed substantially across the entire surface of the TFT substrate so as to cover those elements described above, and the pixel electrode (e.g., an aluminum/molybdenum layered film, an Ag layer or an ITO layer) 12 is formed on the insulative layer. The pixel electrode 12 is electrically connected to the drain electrode of the first TFT 30 at the contact hole 9 formed in the insulative layer and the gate insulating film 24.

The counter substrate of the liquid crystal display device 100 includes a transparent substrate (e.g., a glass substrate; not shown), the counter electrodes (e.g., an ITO layer) 16 provided on the transparent substrate and arranged in a stripe pattern so as to correspond respectively to the columns. The counter electrode 16 is electrically connected to the reference line Bi formed on the TFT substrate at a common transfer section provided outside the display area. The liquid crystal layer 14 provided between the TFT substrate and the counter substrate may be any of various types of liquid crystal layer.

Next, an operation of the liquid crystal display device 100 described above will be described. Note however that the present invention is not limited to a liquid crystal display device, but can suitably be applied widely to electronic devices in general. In view of this, an operating principle of an electronic device of the present invention will first be described with reference to FIG. 3A, FIG. 3B and FIG. 3C, and the operating principle of the liquid crystal display device 100 of the present embodiment will be described thereafter.

Figure 3A:
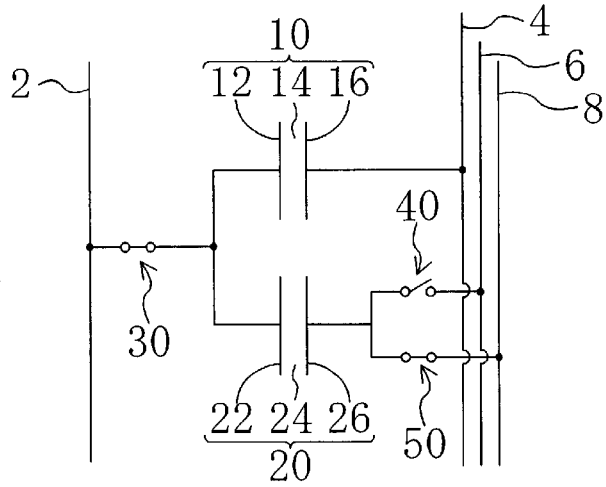
FIG. 3A, FIG. 3B and FIG. 3C are diagrams illustrating an operating principle of an electronic device of the present invention.
Figure 3B:
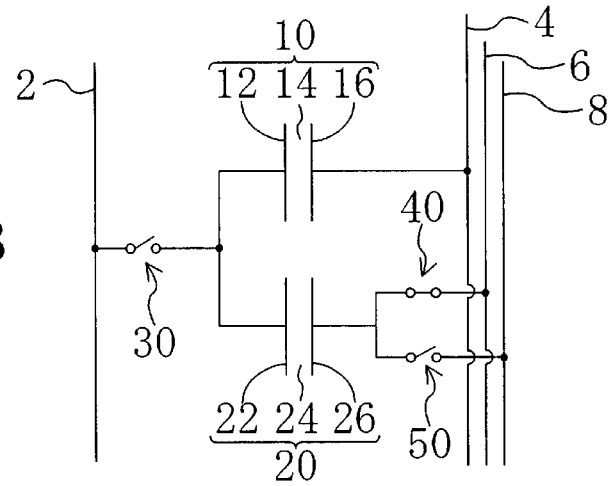
Figure 3C:
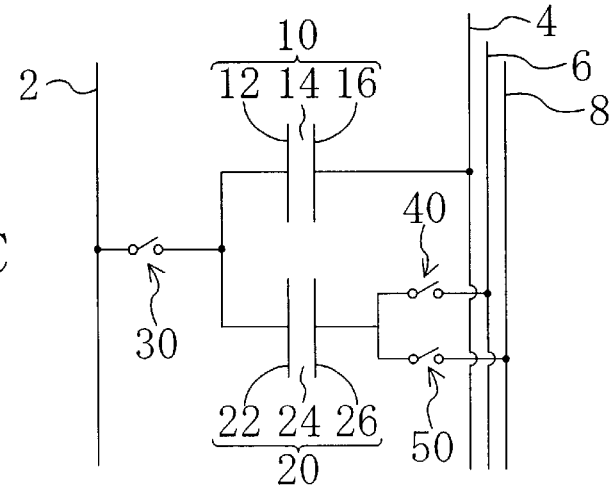

FIG. 3A, FIG. 3B and FIG. 3C are schematic diagrams illustrating the operating principle of the electronic device of the present invention. The elements of the electronic device of the present invention illustrated in FIG. 3A, FIG. 3B and FIG. 3C correspond respectively to those of the liquid crystal display device 100 as follows.

First, a first capacitor 10 and a second capacitor 20 correspond respectively to the liquid crystal capacitor 10 and the storage capacitor 20 of the liquid crystal display device 100. A first electrode 12, a first dielectric layer 14 and a second electrode 16 of the first capacitor 10 correspond respectively to the pixel electrode 12, the liquid crystal layer 14 and the counter electrode 16 of the liquid crystal display device 100. A third electrode 22, a second dielectric layer 24 and a fourth electrode 26 of the second capacitor 20 correspond respectively to the storage capacitor electrode 22, the gate insulating film 24 and the storage capacitor counter electrode 26 of the liquid crystal display device 100.

A first line 2 whose electrical connection to the first electrode 12 and the third electrode 22 is turned ON/OFF by a first switching element 30, and a third line 6 whose electrical connection to the fourth electrode 26 is turned ON/OFF by a second switching element 40, correspond to the signal line Si (first potential). A second line 4 electrically connected to the second electrode 16, and a fourth line 8 whose electrical connection to the fourth electrode 26 is turned ON/OFF by a third switching element 50, correspond to the reference line Bi (second potential). The first switching element 30, the second switching element 40 and the third switching element 50 correspond respectively to the first TFT 30, the second TFT 40 and the third TFT 50.

The electronic device of the present invention operates as follows.

First, the electronic device of the present invention is placed in a first state where the first capacitor 10 and the second capacitor 20 are electrically connected in parallel to each other, as illustrated in FIG. 3A. In the first state, the electrical connection of the first line 2 to the first electrode 12 and the third electrode 22 is ON, the electrical connection between the fourth electrode 26 and the fourth line 8 is ON, and the electrical connection between the fourth electrode 26 and the third line 6 is OFF. In the first state, a predetermined first potential is applied to the first electrode 12 and the third electrode 22, while a predetermined second potential, different from the first potential, is applied to the second electrode 16 and the fourth electrode 26, whereby a predetermined voltage (the potential difference between the first potential and the second potential) is applied between the first electrode 12 and the second electrode 16 and between the third electrode 22 and the fourth electrode 26, thus charging the first capacitor 10 and the second capacitor 20.

Then, the electronic device is placed in a second state where the first capacitor 10 and the second capacitor 20 are electrically connected in series with each other, as illustrated in FIG. 3B. In the second state, the electrical connection of the first line 2 to the first electrode 12 and the third electrode 22 is OFF, the electrical connection between the fourth electrode 26 and the fourth line 8 is OFF, and the electrical connection between the fourth electrode 26 and the third line 6 is ON. In the second state, a predetermined first potential is applied to the fourth electrode 26, while a predetermined second potential is applied to the second electrode 16, whereby a voltage between the first electrode 12 and the second electrode 16 is increased. The mechanism by which the voltage is increased will be described later.

Then, the electronic device is placed in a third state where the fourth electrode 26 is electrically cut off, as illustrated in FIG. 3C. In the present specification, "being electrically cut off" refers to a state of an electrode being not electrically connected to any line. In the third state, the electrical connection of the first line 2 to the first electrode 12 and the third electrode 22 is OFF, the electrical connection between the fourth electrode 26 and the fourth line 8 is OFF, and the electrical connection between the fourth electrode 26 and the third line 6 is OFF. In the third state, the fourth electrode 26 is electrically cut off, whereby the increased voltage is held by the first capacitor 10.

As described above, in the electronic device of the present invention, the first state where the first capacitor 10 and the second capacitor 20 are electrically connected in parallel to each other and the second state where the first capacitor 10 and the second capacitor 20 are electrically connected in series with each other are switched from one to another, thereby increasing the voltage being applied between the first electrode 12 and the second electrode 16. Therefore, it is possible to apply a voltage higher than the voltage (the potential difference between the first potential and the second potential) that is supplied between the first electrode 12 and the second electrode 16 from an external power supply via a line. As a result, the electronic device can be driven with a relatively low voltage supply from an external power supply, thereby realizing a low voltage driving operation.

The mechanism by which the voltage being applied between the first electrode 12 and the second electrode 16 is increased in the second state will now be described.

For the sake of simplicity, it is assumed that: in the first state, a ground potential (the first potential) is applied to the first electrode 12 and the third electrode 22 while a predetermined potential $V_0$ (the second potential) is applied to the second electrode 16 and the fourth electrode 26; and in the second state, the predetermined potential $V_0$ is applied to the second electrode 16 while the ground potential is applied to the fourth electrode 26. Of course, the present invention is not limited to this.

First, the ground potential is applied to the first electrode 12 and the third electrode 22 while the predetermined voltage $V_0$ is applied to the second electrode 16 and the fourth electrode 26 in the first state. As a result, a predetermined voltage $V_0$ is applied between the first electrode 12 and the second electrode 16 and between the third electrode 22 and the fourth electrode 26, thus charging the first capacitor 10 and the second capacitor 20. At this time, a charge $Q_1$ to be stored in the first electrode 12 and a charge $Q_2$ to be stored in the third electrode 22 are given respectively by Expressions (1) and (2) below (where $C_1$ denotes the electrostatic capacity of the first capacitor 10 and $C_2$ denotes the electrostatic capacity of the second capacitor 20):

$$Q_1=C_1V_0 \quad (1)$$

$$Q_2=C_2V_0 \quad (2)$$

Then, in the second state, the potential $V_0$ is applied to the second electrode 16 while the ground potential is applied to the fourth electrode 26. At this time, a charge $Q_1'$ to be stored in the first electrode 12 and a charge $Q_2'$ to be stored in the third electrode 22 in the second state are given respectively by Expressions (3) and (4) below (where $V_1'$ denotes the potential difference (voltage) between the first electrode 12 and the second electrode 16, and $V_2'$ denotes the potential difference (voltage) between the third electrode 22 and the fourth electrode 26):

$$Q_1'=C_1V_1' \quad (3)$$

$$Q_2'=C_2V_2' \quad (4)$$

The first electrode 12 and the third electrode 22 are electrically connected to each other, and in the second state, the electrical connection of the first line 2 to the first electrode 12 and the third electrode 22 is OFF. Therefore, the total amount (sum) of the charge $Q_1$ stored in the first electrode 12 and the charge $Q_2$ stored in the third electrode 22 in the first state is equal to the total amount (sum) of the charge $Q_1'$ stored in the first electrode 12 and the charge $Q_2'$ stored in the third electrode 22 in the second state. The relationship is given by Expression (5) below:

$$Q_1+Q_2=Q_1'+Q_2' \quad (5)$$

Applying Expressions (1) to (4) to Expression (5) yields Expression (6) below:

$$C_1V_0+C_2V_0=C_1V_1'+C_2V_2' \quad (6)$$

on the other hand, in the second state, the potential $V_0$ is applied to the second electrode 16, and the ground potential is applied to the fourth electrode 26. Therefore, the potential difference (voltage) between the first electrode 12 and the second electrode 16 and the potential difference (voltage) between the third electrode 22 and the fourth electrode 26 have a relationship given by Expression (7) below:

$$V_0=V_1'-V_2' \quad (7)$$

From Expressions (6) and (7), the potential difference (voltage) $V_1'$ between the first electrode 12 and the second electrode 16 is given by Expression (8) below:

$$V_1'=\{(2+C_1/C_2)/(1+C_1/C_2)\}\cdot V_0 \quad (8)$$

In Expression (8), $\{(2+C_1/C_2)/(1+C_1/C_2)\}>1$. Therefore, the absolute value of the voltage $V_1'$ is greater than the absolute value of the voltage $V_0$, indicating that the voltage $V_0$ applied between the first electrode 12 and the second electrode 16 in the first state has been increased to the voltage $V_1'$ having a greater absolute value.

The degree of voltage increase is determined by the ratio between the electrostatic capacity $C_1$ of the first capacitor 10 and the electrostatic capacity $C_2$ of the second capacitor 20. Specifically, the degree of voltage increase is greater as $C_2$ is greater with respect to $C_1$. For example, where $C_1=C_2$ (where $C_1/C_2=1$), $V_1'=1.5V_0$ from Expression (8), indicating a voltage increase by a factor of about 1.5. Where $C_2$ is sufficiently greater than $C_1$ (where $C_1/C_2\cong 0$), $V_1'\cong 2.0V_0$ from Expression (8), indicating a voltage increase by a factor of about 2.

In the electronic device of the present invention, the voltage applied between the first electrode 12 and the second electrode 16 is increased by the mechanism as described above.

Figure 4:
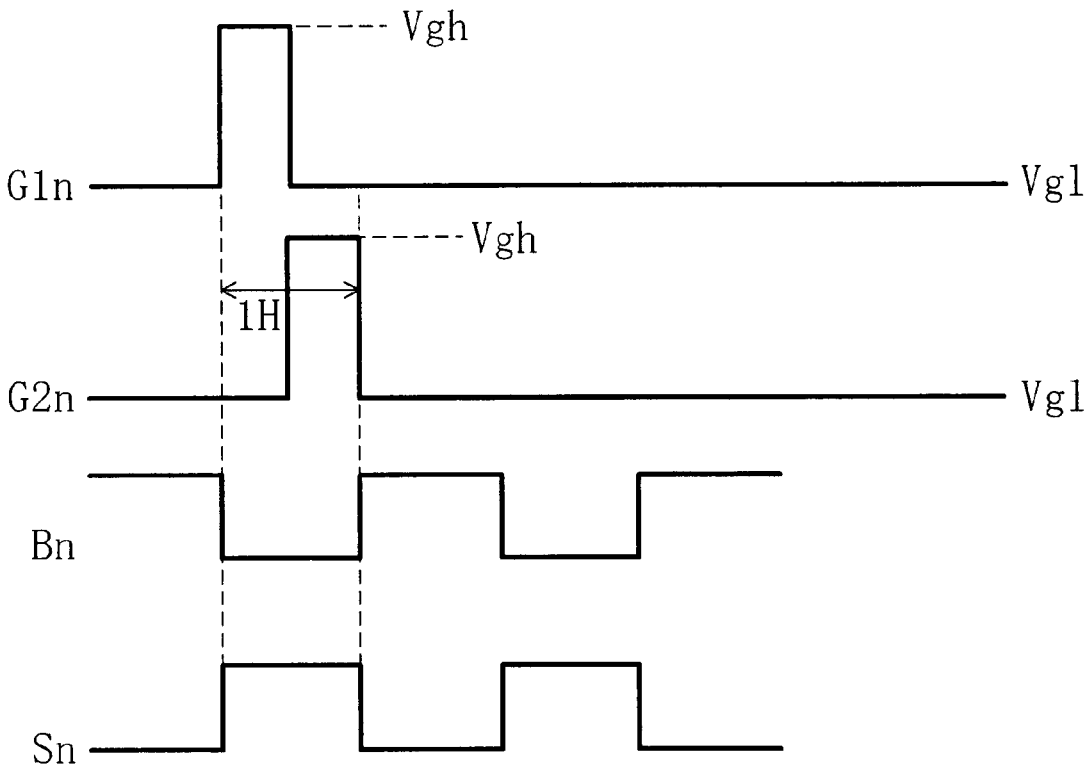
FIG. 4 is a timing chart for driving the liquid crystal display device 100, which is an electronic device according to Embodiment 1 of the present invention.

Next, the operation of the liquid crystal display device 100 illustrated in FIG. 1, which is an electronic device according to Embodiment 1 of the present invention, will be described with reference to FIG. 1 and FIG. 4. FIG. 4 is a timing chart for driving the liquid crystal display device 100. In the following description, the operation will be described with respect to an $n^{th}$ row-$n^{th}$ column pixel.

First, a scanning voltage Vgh is supplied from the scanning line G1*n* to the gate electrodes of the first TFT 30 and the third TFT 50, whereby the electrical connection of the signal line Sn to the pixel electrode 12 and the storage capacitor electrode 22 is ON and the electrical connection between the storage capacitor counter electrode 26 and the reference line Bn is also ON (the first half of 1H). This results in a state where the liquid crystal capacitor 10 and the storage capacitor 20 are electrically connected in parallel to each other. At this time, a voltage Vgl (OFF voltage) lower than the scanning voltage Vgh (ON voltage) is supplied from the scanning line G2*n* to the gate electrode of the second TFT 40, whereby the electrical connection between the storage capacitor counter electrode 26 and the signal line Sn is OFF. This state corresponds to the first state illustrated in FIG. 3A. As illustrated in FIG. 4, at the same timing as when the scanning voltage Vgh is supplied from the scanning line G1*n*, a predetermined signal voltage is supplied from the signal line Sn to the pixel electrode 12 and the storage capacitor electrode 22 and a predetermined counter voltage (reference voltage) is supplied from the reference line Bn to the counter electrode 16 and the storage capacitor counter electrode 26, whereby a predetermined voltage (the difference between the signal voltage and the counter voltage) is applied between the pixel electrode 12 and the counter electrode 16 and between the storage capacitor electrode 22 and the storage capacitor counter electrode 26, thus charging the liquid crystal capacitor 10 and the storage capacitor 20.

Then, the voltage Vgl is supplied from the scanning line G1*n* to the gate electrodes of the first TFT 30 and the third TFT 50, whereby the electrical connection of the signal line Sn to the pixel electrode 12 and the storage capacitor electrode 22 is OFF and the electrical connection between the storage capacitor counter electrode 26 and the reference line Bn is OFF (the second half of 1H). Moreover, the scanning voltage Vgh is supplied from the scanning line G2*n* to the gate electrode of the second TFT 40, whereby the electrical connection between the storage capacitor counter electrode 26 and the signal line Sn is ON. This results in a state where the first capacitor 10 and the second capacitor 20 are electrically connected in series with each other. This state corresponds to the state illustrated in FIG. 3B. In this state, a predetermined counter voltage (reference voltage) is supplied from the reference line Bn to the counter electrode 16 and a predetermined signal voltage is supplied from the signal line Sn to the storage capacitor counter electrode 26, whereby the voltage applied between the pixel electrode 12 and the counter electrode 16 is increased by the mechanism as described above.

Then, the voltage Vgl is supplied from the scanning line G2*n* to the gate electrode of the second TFT 40, whereby the electrical connection between the storage capacitor counter electrode 26 and the signal line Sn is OFF (a period during which another scanning line pair is selected). This results in a state where the storage capacitor counter electrode 26 is electrically cut off. This state corresponds to the state illustrated in FIG. 3C. In this state, the increased voltage is held by the liquid crystal capacitor 10.

As described above, with the liquid crystal display device 100 of the present invention, a voltage higher than the voltage supplied from the external power supply can be applied across the liquid crystal layer 14 provided between the pixel electrode 12 and the counter electrode 16. As a result, the liquid crystal display device 100 can be driven with a relatively low voltage supply from an external power supply, thereby realizing a low voltage driving operation.

Moreover, in the liquid crystal display device 100, the storage capacitor 20 is provided corresponding to the liquid crystal capacitor 10, whereby a booster circuit for increasing a voltage by the mechanism as described above is provided for each pixel. Thus, the voltage supplied from the external power supply is efficiently increased with a reduced voltage loss.

The operating principle of the electronic device of the present invention illustrated in FIG. 3A, FIG. 3B and FIG. 3C has been described with respect to a case where the second line 4 is always electrically connected to the second electrode 16. However, the present invention is not limited thereto, and may alternatively employ any other configuration as long as the second line 4 is electrically connected to the counter electrode 16 at least temporarily. Moreover, the description above has been made with respect to a case where there are provided the second switching element 40 for turning ON/OFF the electrical connection between the third line 6 and the fourth electrode 26, and the third TFT 50 for turning ON/OFF the electrical connection between the fourth line 8 and the fourth electrode 26. However, the present invention is not limited thereto, and may alternatively employ any other configuration as long as the state where the fourth electrode 26 is electrically connected to the third line 6 and the state where the fourth electrode 26 is electrically connected to the fourth line 8 can be switched from one to another.

The operation of another electronic device of the present invention will now be described with reference to FIG. 5A, FIG. 5B, FIG. 6A, FIG. 6B and FIG. 6C. The electronic device further includes an additional switching element for turning ON/OFF the electrical connection between the second line 4 and the second electrode 16, and the state where the fourth electrode 26 is electrically connected to the third line 6 and the state where the fourth electrode 26 is electrically connected to the fourth line 8 can be switched from one to another. As illustrated in FIG. 5A, FIG. 5B, FIG. 6A, FIG. 6B and FIG. 6C, in the electronic device, the electrical connection between the second line 4 and the second electrode 16 is turned ON/OFF by an additional switching element 70. The electrical connection of the fourth electrode 26 to the third line 6 and the fourth line 8 is controlled by a connection switching element 80 for switching the state where the fourth electrode 26 is electrically connected to the third line 6 and the state where the fourth electrode 26 is electrically connected to the fourth line 8 from one to another. For example, the connection switching element 80 may be a CMOS transistor using polysilicon. In the following description, the respective states illustrated in FIG. 5A, FIG. 5B and FIG. 6A will not be described in detail because they are as those illustrated in FIG. 3A, FIG. 3B and FIG. 3C, respectively.

Figure 5A:
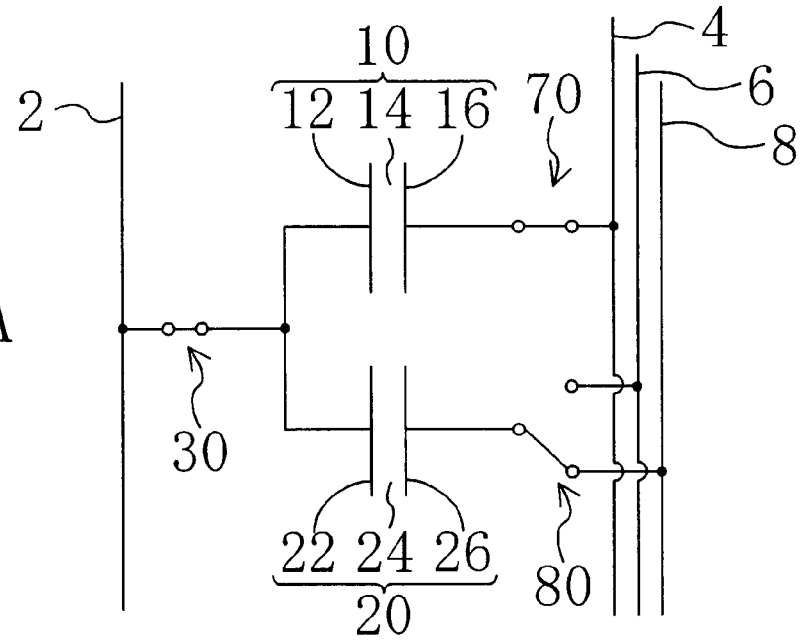
FIG. 5A and FIG. 5B are diagrams illustrating an operating principle of another electronic device of the present invention.

First, in the state where the first capacitor 10 and the second capacitor 20 are connected in parallel to each other as illustrated in FIG. 5A, the first capacitor 10 and the second capacitor 20 are charged. This state corresponds to the state illustrated in FIG. 3A.

Figure 5B:
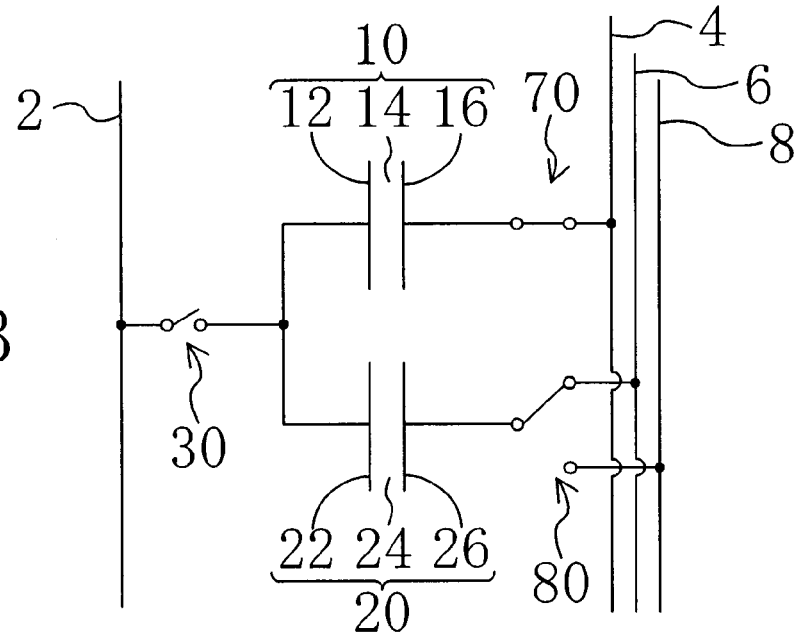

Then, in the state where the first capacitor 10 and the second capacitor 20 are electrically connected in series with each other as illustrated in FIG. 5B, the voltage applied between the first electrode 12 and the second electrode 16 is increased. This state corresponds to the state illustrated in FIG. 3B.

Figure 6A:
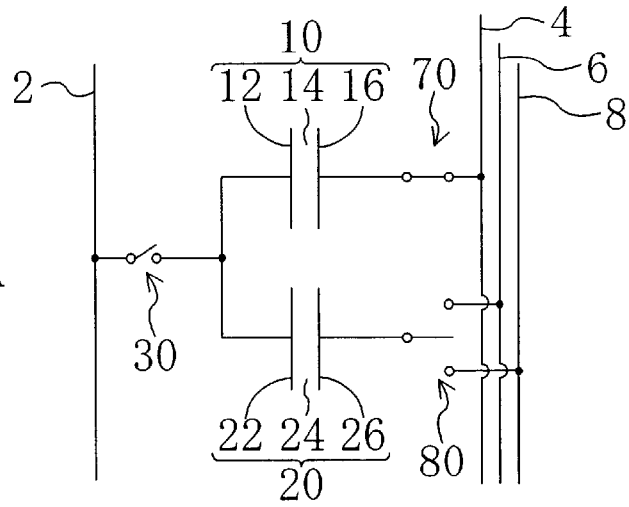
FIG. 6A, FIG. 6B and FIG. 6C are diagrams illustrating an operating principle of still another electronic device of the present invention.
Figure 6B:
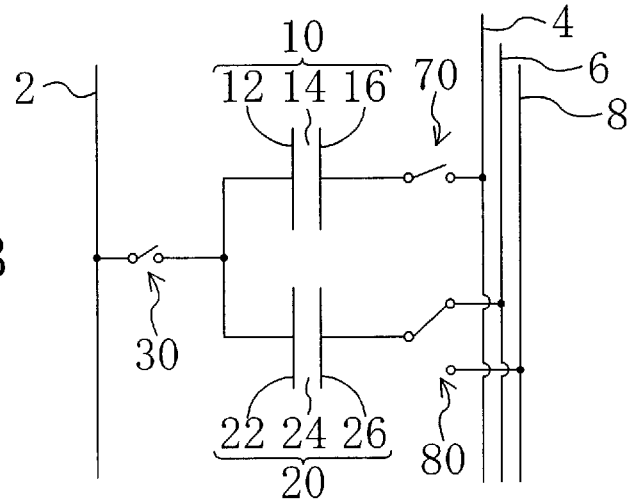
Figure 6C:
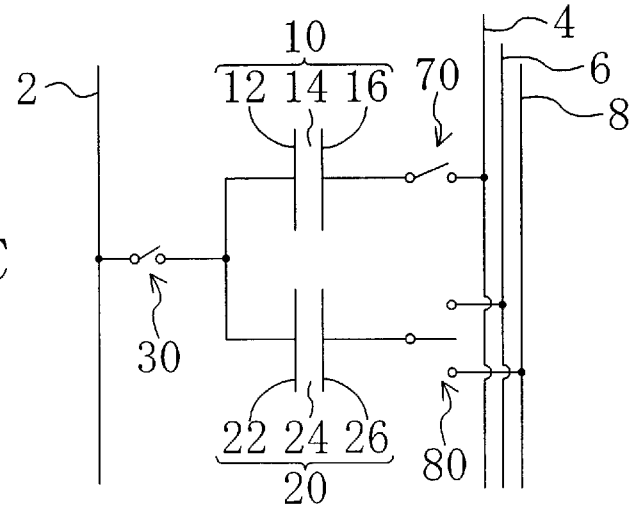

Then, the electronic device is placed in the state where at least one of the second electrode 16 and the fourth electrode 26 is electrically cut off as illustrated in FIG. 6A, FIG. 6B or FIG. 6C, whereby the increased voltage is held by the first capacitor 10.

In the state illustrated in FIG. 6A, as in the state illustrated in FIG. 3C, the increased voltage is held by electrically cutting off the fourth electrode 26. In the electronic device including the additional switching element 70, the increased voltage can be held also by electrically cutting off the second electrode 16 as illustrated in FIG. 6B.

Moreover, the increased voltage can be held also by electrically cutting off both of the second electrode 16 and the fourth electrode 26 as illustrated in FIG. 6C. By driving the electronic device so that the voltage is held in the state illustrated in FIG. 6C, it is possible to reduce the fluctuations of the voltage applied to the first capacitor 10 via a parasitic capacitor due to voltage fluctuations along the first line 2, the second line 4, the third line 6 and the fourth line 8.

EMBODIMENT 2

Figure 7:
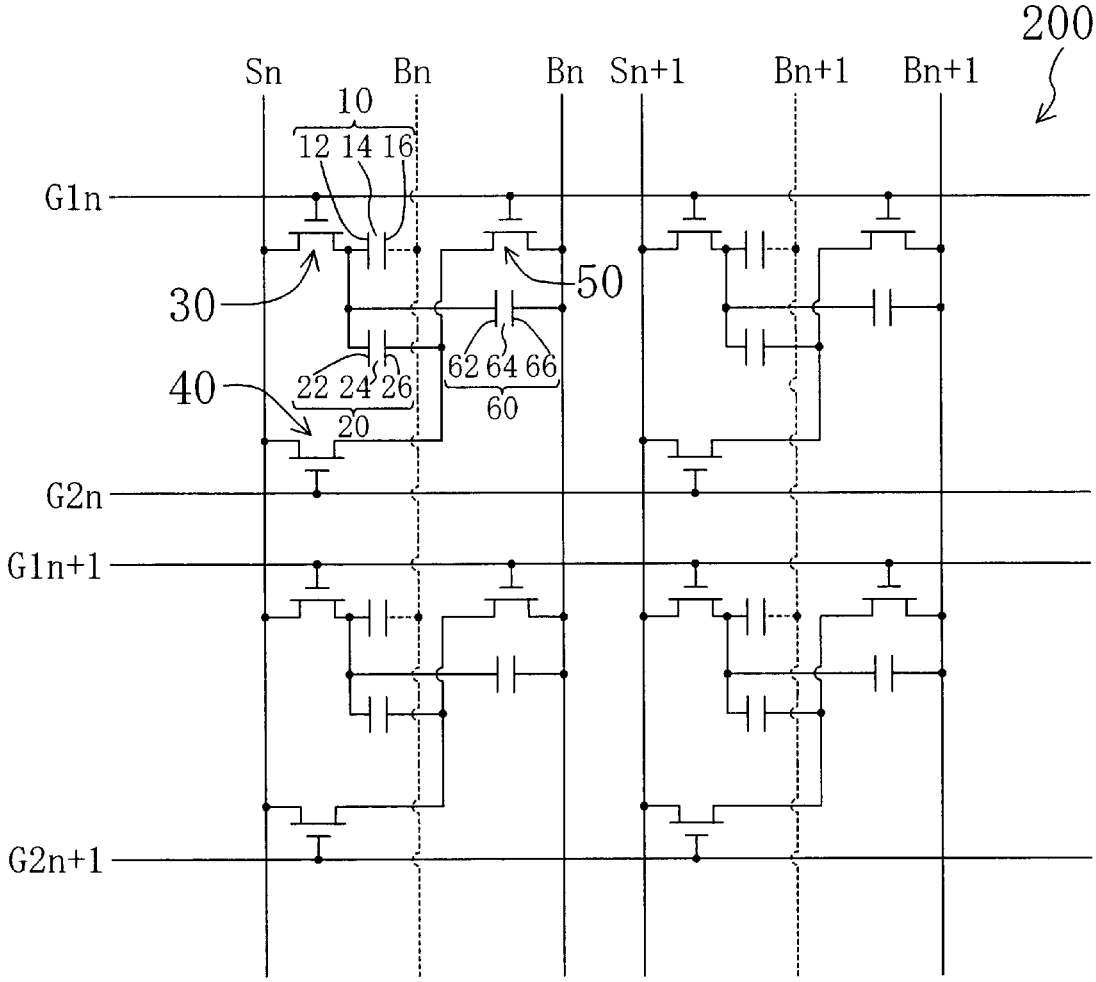
FIG. 7 is a diagram illustrating an equivalent circuit of a liquid crystal display device 200, which is an electronic device according to Embodiment 2 of the present invention.
Figure 8:
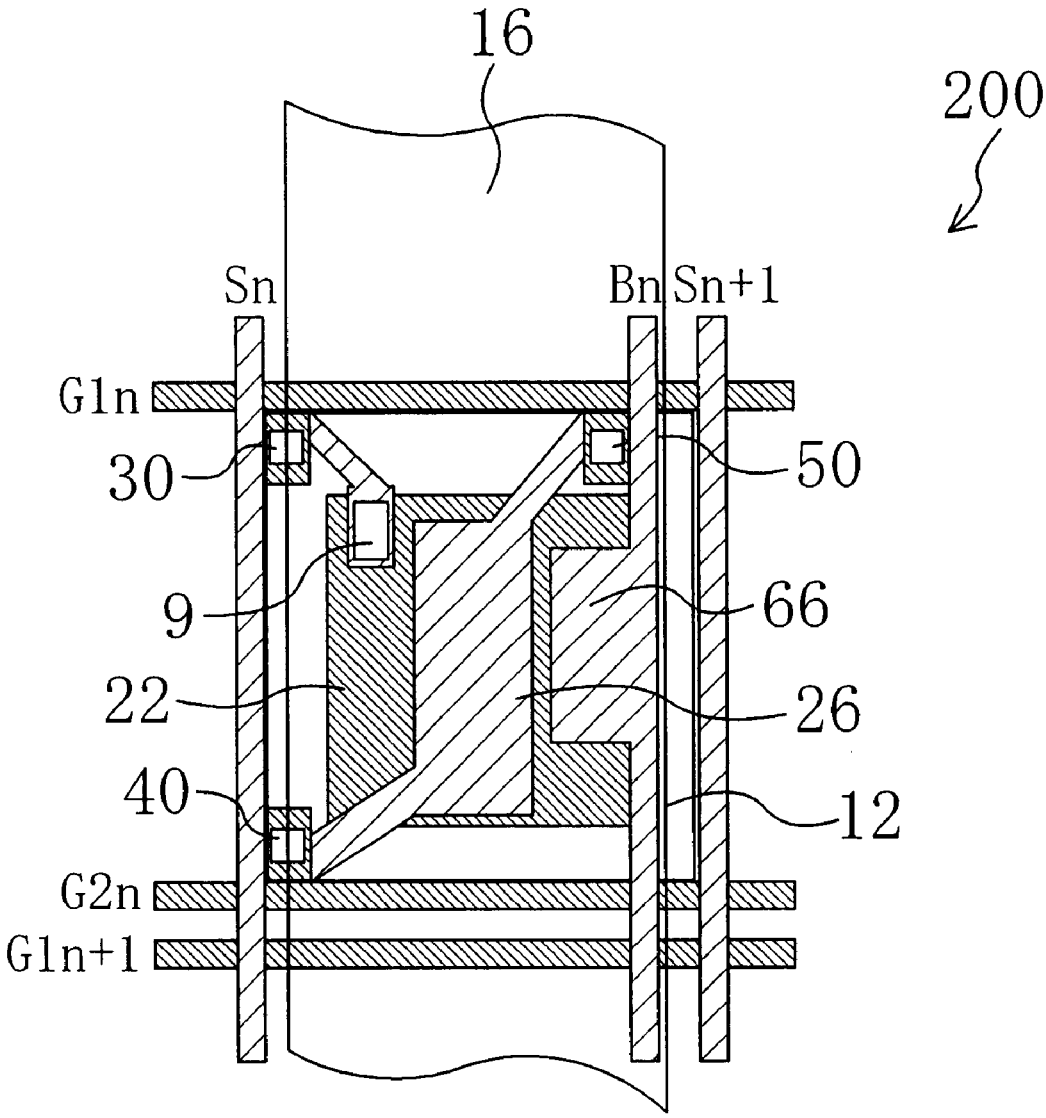
FIG. 8 is a top view schematically illustrating a portion of the liquid crystal display device 200, which is an electronic device according to Embodiment 2 of the present invention, corresponding to one pixel.

A liquid crystal display device 200, which is an electronic device according to Embodiment 2 of the present invention, will now be described with reference to FIG. 7 and FIG. 8. FIG. 7 is a diagram illustrating an equivalent circuit of the liquid crystal display device 200, and FIG. 8 is a top view schematically illustrating a portion of the liquid crystal display device 200 corresponding to one pixel. The liquid crystal display device 200 will be described below while focusing on the differences thereof from the liquid crystal display device 100 of Embodiment 1. Elements having substantially the same functions as those of the liquid crystal display device 100 will be denoted by the same reference numerals and will not be further discussed below.

The liquid crystal display device 200 includes a plurality of additional storage capacitors 60 corresponding respectively to the plurality of liquid crystal capacitors 10. Each storage capacitor 60 includes an additional storage capacitor electrode 62 electrically connected to the pixel electrode 12 and an additional storage capacitor counter electrode 66 opposing the storage capacitor electrode 62 via a third dielectric layer 64.

The electrical connection between the storage capacitor electrode 62 and the signal line Si is turned ON/OFF by the first TFT 30, while the storage capacitor counter electrode 66 is electrically connected to the reference line Bi, and the storage capacitor 60 is electrically connected in parallel to the liquid crystal capacitor 10.

The storage capacitor electrode 62 is made from the same metal layer as the storage capacitor electrode 22 of the storage capacitor 20, and is typically formed integrally with the storage capacitor electrode 22. Moreover, the storage capacitor counter electrode 66 is made from the same metal layer as the storage capacitor counter electrode 26 of the storage capacitor 20, and is typically formed integrally with the reference line Bi.

Furthermore, the third dielectric layer 64 provided between the storage capacitor electrode 62 and the storage capacitor counter electrode 66 is formed from the same film as the gate insulating film 24 of the storage capacitor 20.

While the gate insulating film 24 is formed by depositing a silicon nitride layer, for example, there may occur thickness variations in the gate insulating film 24 during the deposition step. Since the electrostatic capacity value of a capacitor depends on the thickness of the dielectric layer provided between electrodes, thickness variations in the gate insulating film 24 inside the display area may cause variations in the electrostatic capacity $C_2$ of the storage capacitor 20 (hereinafter, the electrostatic capacity $C_2$ of the storage capacitor 20 will be referred to simply as "electrostatic capacity $C_2$").

In a liquid crystal display device that does not include the additional storage capacitor 60, the increased voltage $V_1'$ is given by Expression (8) as described above, where $V_0$ denotes the voltage supplied from the external power supply. Therefore, if there are variations in the electrostatic capacity $C_2$, variations occur also in the degree of voltage increase.

In the liquid crystal display device 200 of the present embodiment, the third dielectric layer 64 of the storage capacitor 60 electrically connected in parallel to the liquid crystal capacitor 10 is made from the same film as the gate insulating film 24 of the storage capacitor 20, as described above, thereby reducing the variations in the degree of voltage increase for the following reasons.

In the liquid crystal display device 200 including the storage capacitor 60 electrically connected in parallel to the liquid crystal capacitor 10, the increased voltage $V_1'$ is given by Expression (9) below, where $C_3$ denotes the electrostatic capacity of the storage capacitor 60 (hereinafter, the electrostatic capacity $C_3$ of the storage capacitor 60 will be referred to simply as "electrostatic capacity $C_3$"):

$$V_1'=[\{2+(C_1+C_3)/(C_2\}/\{1+(C_1+C_3)/C_2\}]\cdot V_0 \quad (9)$$

Moreover, since the third dielectric layer 64 of the storage capacitor 60 is made from the same film as the gate insulating film 24 of the storage capacitor 20, the gate insulating film 24 and the third dielectric layer 64 have substantially the same thickness in the same pixel. Therefore, if the value of the electrostatic capacity $C_2$ in a pixel is greater than the average value of the electrostatic capacity $C_2$ in the display area, the value of the electrostatic capacity $C_3$ in the same pixel is greater than the average value of the electrostatic capacity $C_3$ in the display area. Conversely, if the value of the electrostatic capacity $C_2$ in a pixel is less than the average value of the electrostatic capacity $C_2$ in the display area, the value of the electrostatic capacity $C_3$ in the same pixel is less than the average value of the electrostatic capacity $C_3$ in the display area.

As described above, in the liquid crystal display device 200, variations in the electrostatic capacity $C_3$ of the storage capacitor 60 occur in a similar manner as the variations in the electrostatic capacity $C_2$ of the storage capacitor 20. Therefore, the influence of the variations in the electrostatic capacity $C_2$ of the storage capacitor 20 on the variations in the degree of voltage increase is somewhat cancelled out, as can be seen from Expression (9). As a result, the variations in the degree of voltage increase due to the thickness variations in the gate insulating film 24 are reduced.

EMBODIMENT 3

Figure 9:
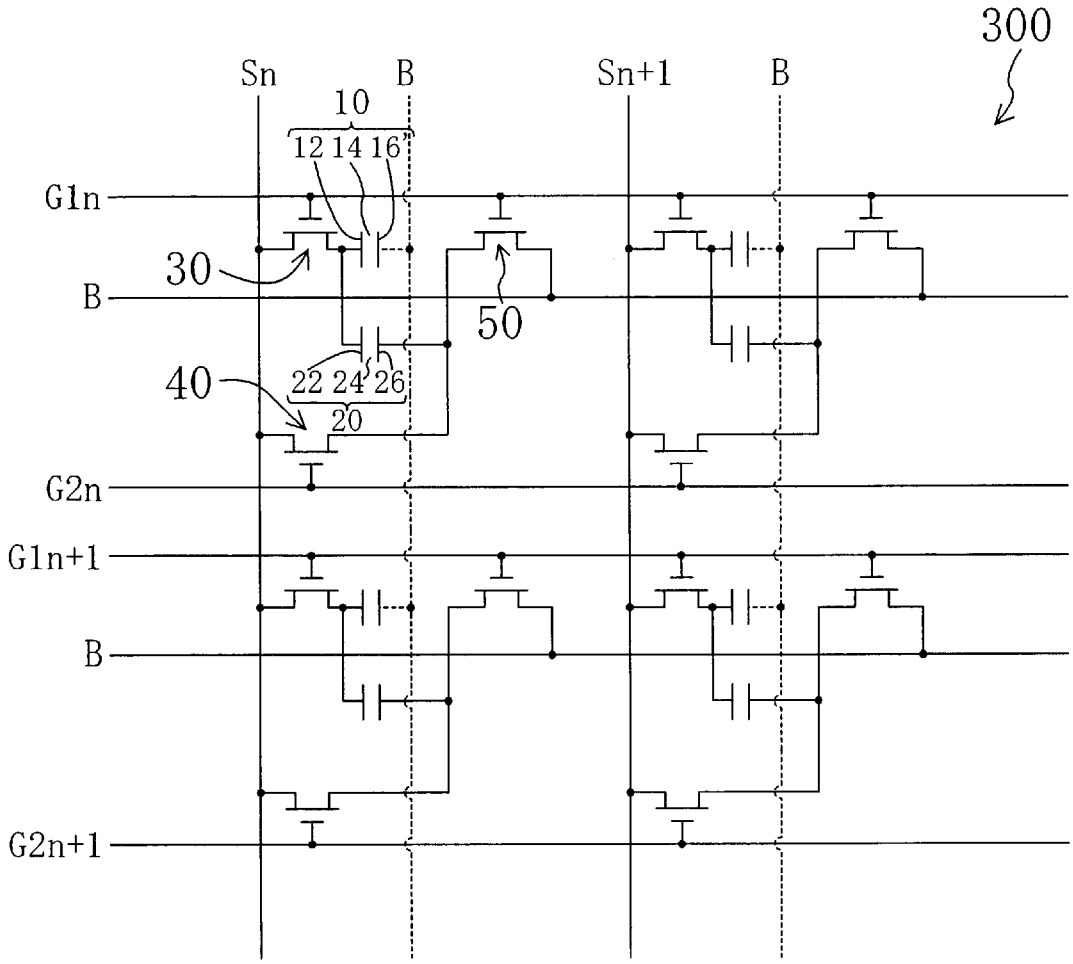
FIG. 9 is a diagram illustrating an equivalent circuit of a liquid crystal display device 300, which is an electronic device according to Embodiment 3 of the present invention.

A liquid crystal display device 300, which is an electronic device according to Embodiment 3 of the present invention, will now be described with reference to FIG. 9 and FIG. 10. FIG. 9 is a diagram illustrating an equivalent circuit of the liquid crystal display device 300, and FIG. 10 is a top view schematically illustrating a portion of the liquid crystal display device 300 corresponding to one pixel.

Figure 10:
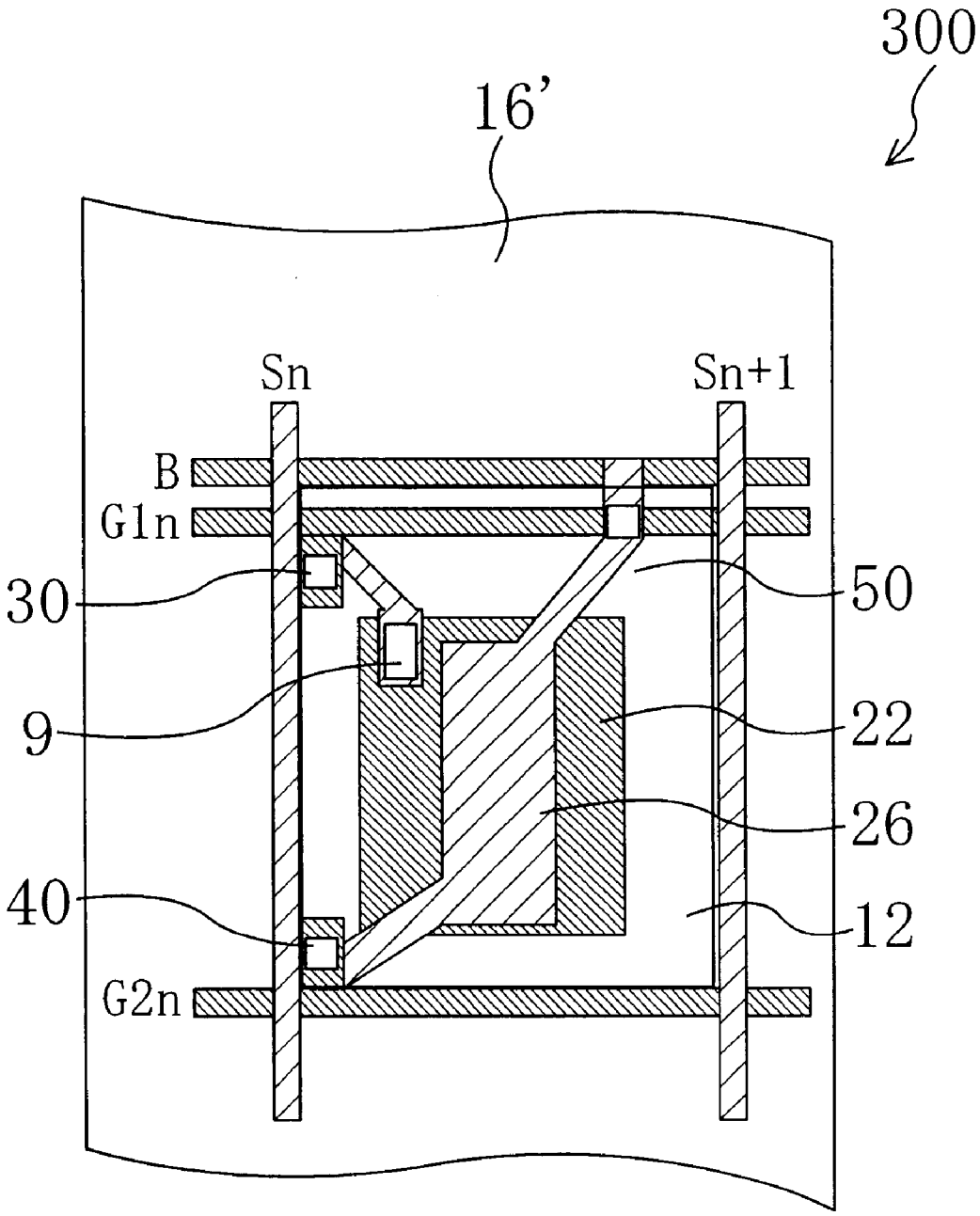
FIG. 10 is a top view schematically illustrating a portion of the liquid crystal display device 300, which is an electronic device according to Embodiment 3 of the present invention, corresponding to one pixel.

The liquid crystal display device 300 includes a single counter electrode (e.g., an ITO layer) 16' provided substantially across the entire surface of the counter substrate as illustrated in FIG. 10. The TFT substrate of the liquid crystal display device 300 includes a reference line B provided for each column so as to cross the signal line Si, as illustrated in FIG. 9 and FIG. 10, and the reference line B is electrically connected to the counter electrode 16' at a common transfer section provided outside the display area.

The reference line B is formed by patterning the same metal layer as the scanning lines G1*i* and G2*i*, etc., and supplies a common counter voltage (reference voltage) to the counter electrode 16' and the storage capacitor counter electrodes 26 of all pixels.

Employing such a configuration as described above simplifies the structure of a liquid crystal display device and prevents the production process therefor from being complicated, whereby it is possible to easily and efficiently produce a liquid crystal display device capable of operating with a low voltage.

EMBODIMENT 4

Figure 11:
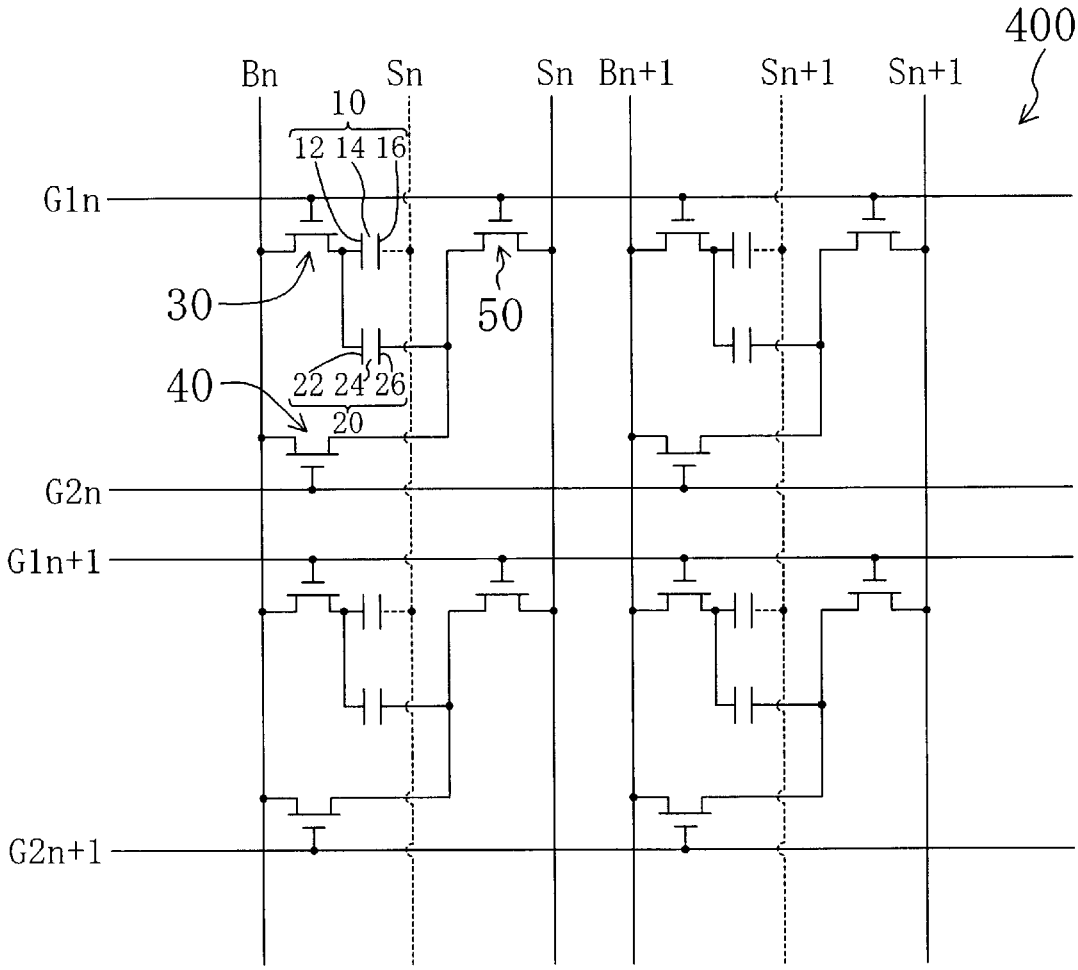
FIG. 11 is a diagram illustrating an equivalent circuit of a liquid crystal display device 400, which is an electronic device according to Embodiment 4 of the present invention.

A liquid crystal display device 400, which is an electronic device according to Embodiment 4 of the present invention, will now be described with reference to FIG. 11 and FIG. 12. FIG. 11 is a diagram illustrating an equivalent circuit of the liquid crystal display device 400, and FIG. 12 is a top view schematically illustrating a portion of the liquid crystal display device 400 corresponding to one pixel.

Figure 12:
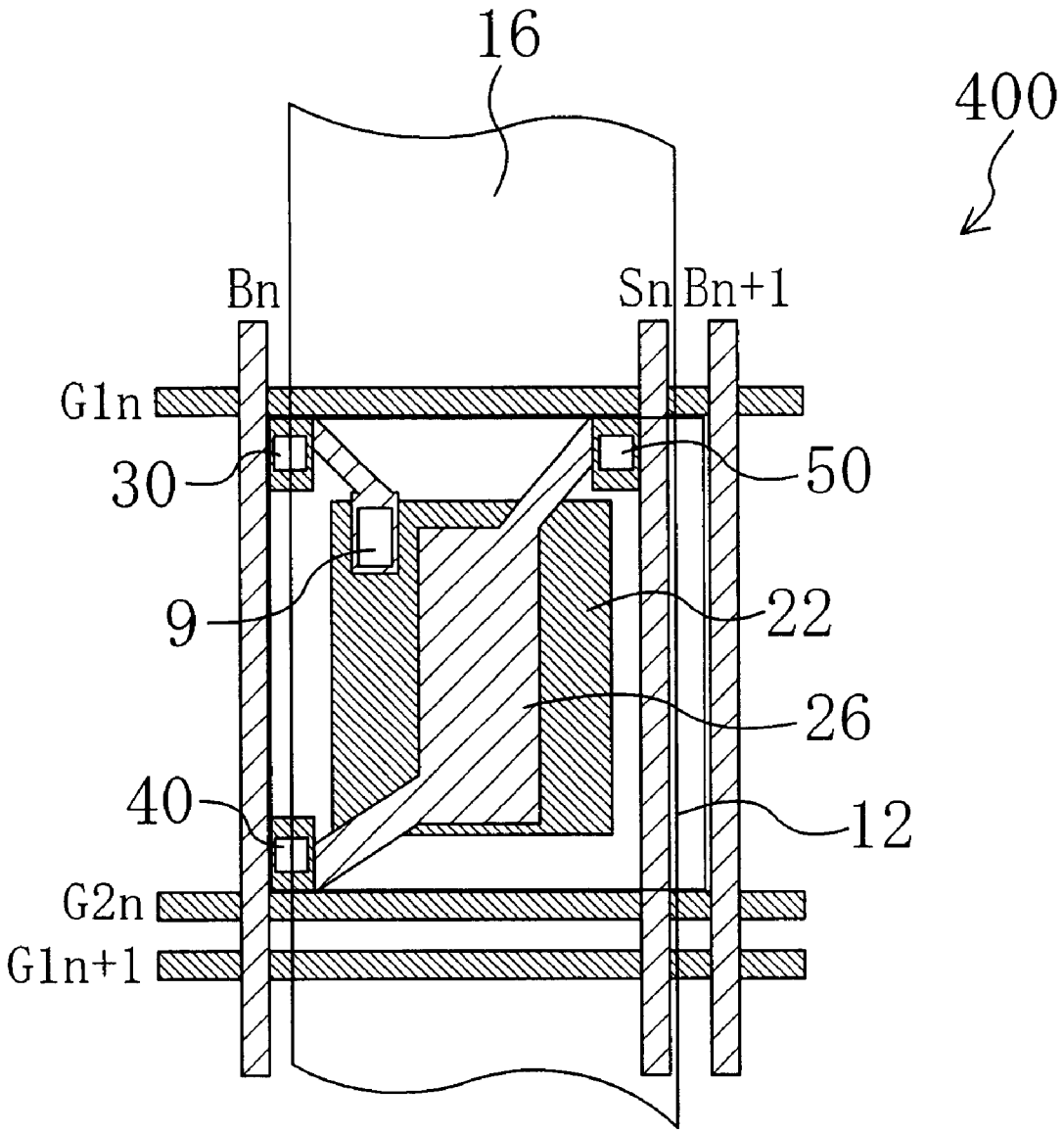
FIG. 12 is a top view schematically illustrating a portion of the liquid crystal display device 400, which is an electronic device according to Embodiment 4 of the present invention, corresponding to one pixel.

The liquid crystal display device 400 of Embodiment 4 is similar to the liquid crystal display device 100 of Embodiment 1 but with the signal line Si and the reference line Bi are switched to each other, as illustrated in FIG. 11 and FIG. 12. The reference line Bi of the liquid crystal display device 400 supplies a reference voltage to the pixel electrode 12, the storage capacitor electrode 22 and the storage capacitor counter electrode 26, and the signal line Si thereof supplies a signal voltage to the counter electrode 16 and the storage capacitor counter electrode 26.

The liquid crystal display device 400 having such a configuration can also be a liquid crystal display device capable of operating with a low voltage as the liquid crystal display device 100. Of course, the liquid crystal display device 400 may alternatively include an additional storage capacitor as in the liquid crystal display device 200 of Embodiment 2.

In a liquid crystal display device in which a signal voltage is supplied to an electrode on the counter substrate side, as in the liquid crystal display device 400, it is preferred that the counter electrode provided on the counter substrate is in the form of a plurality of electrically independent electrodes arranged in a stripe pattern and provided so as to cross the scanning lines.

EMBODIMENT 5

In Embodiments 1 to 4 above, liquid crystal display devices in which storage capacitors are provided so as to correspond respectively to liquid crystal capacitors and a functional block functioning as a booster circuit is provided for each pixel have been described. A liquid crystal display device 500, which is an electronic device according to Embodiment 5 of the present invention, is different from the liquid crystal display devices of Embodiments 1 to 4 in that storage capacitors are provided so as to correspond respectively to signal lines and a functional block functioning as a booster circuit is provided for each signal line.

Figure 13:
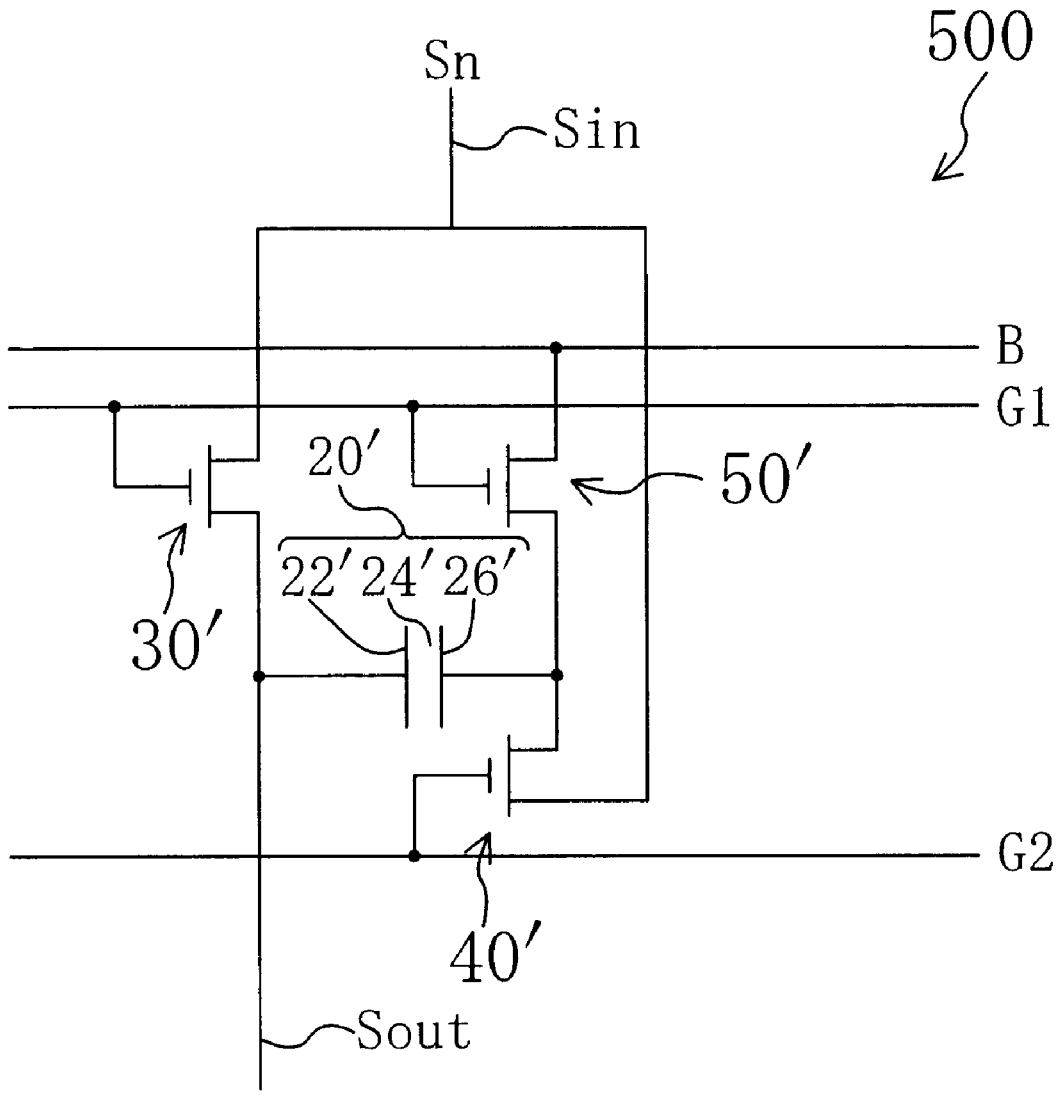
FIG. 13 is a diagram illustrating an equivalent circuit of a booster circuit portion of a liquid crystal display device 500, which is an electronic device according to Embodiment 5 of the present invention.

The liquid crystal display device 500, which is an electronic device according to Embodiment 5 of the present invention, will now be described with reference to FIG. 13. FIG. 13 is a diagram illustrating an equivalent circuit of a portion of the liquid crystal display device 500 that functions as a booster circuit.

In the liquid crystal display devices of Embodiments 1 to 4, the storage capacitors 20 are provided so as to correspond respectively to the liquid crystal capacitors 10 that are arranged in a matrix pattern. In contrast, in the liquid crystal display device 500 of Embodiment 5, storage capacitor 20' are provided so as to correspond respectively to the signal lines Si (a signal line Sn provided in the $n^{th}$ column will be shown in FIG. 13 and FIG. 14 to be discussed later) that are provided so that there is one signal line Sn for each column as illustrated in FIG. 13.

Each storage capacitor 20' includes a storage capacitor electrode 22' electrically connected to the pixel electrode of each liquid crystal capacitor belonging to the same column, a storage capacitor counter electrode 26' opposing the storage capacitor electrode 22', and the gate insulating film 24' provided between the storage capacitor electrode 22' and the storage capacitor counter electrode 26'.

The signal line Si supplies a signal voltage to the pixel electrode, the storage capacitor electrode 22' and the storage capacitor counter electrode 26'. The signal line Si includes a signal line input section Sin to which a signal voltage from a driving circuit (driver) is input, and a signal line output section Sout from which a signal voltage is output to the pixel electrode. The electrical connection of the signal line Si (signal line input section Sin) to the pixel electrode and the storage capacitor electrode 22' is turned ON/OFF by a first TFT 30', and the electrical connection between the signal line Si (signal line input section Sin) and the storage capacitor counter electrode 26' is turned ON/OFF by a second TFT 40'. In an active matrix type liquid crystal display device, a switching element (e.g., a TFT) is provided for each pixel, and the electrical connection between the signal line Si (signal line input section Sin) and the pixel electrode is turned ON/OFF by the switching element and the first TFT 30'. Nevertheless, the switching element provided for each pixel and the scanning line for controlling the switching element will not be discussed in the following description for the sake of simplicity.

The liquid crystal display device 500 includes the reference line B for supplying a counter voltage (reference voltage) to the storage capacitor counter electrode 26', and the reference line B is typically provided so as to cross the signal line Si. The electrical connection between the reference line B and the storage capacitor counter electrode 26' is turned ON/OFF by a third TFT 50'.

The liquid crystal display device 500 further includes a scanning line G1 provided so as to cross the signal line Si for supplying a scanning signal to the first TFT 30' and the third TFT 50', and a scanning line G2 provided so as to also cross the signal line Si for supplying a scanning signal to the second TFT 40'.

Figure 14:
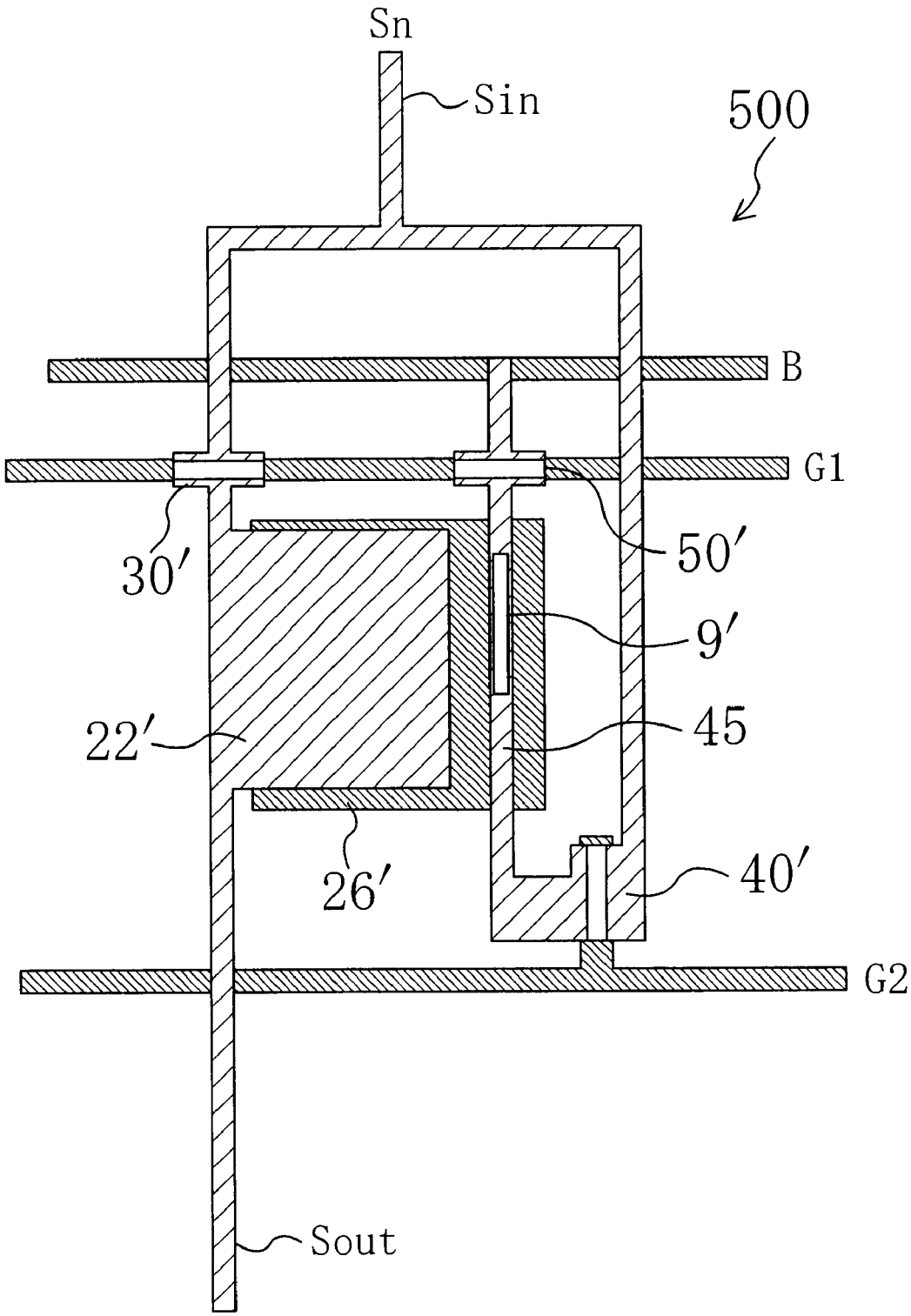
FIG. 14 is a top view illustrating the booster circuit portion of the liquid crystal display device 500, which is an electronic device according to Embodiment 5 of the present invention.

Next, the configuration of the liquid crystal display device 500 will be described in greater detail with reference to FIG. 14. FIG. 14 is a top view schematically illustrating a portion of the liquid crystal display device 500 that functions as a booster circuit. The liquid crystal display device 500 includes a TFT substrate (not shown), a counter substrate (not shown) and a liquid crystal layer (not shown) provided between the TFT substrate and the counter substrate. Again, the switching element provided for each pixel and the scanning line for controlling the switching element will not be discussed in the following description.

The TFT substrate of the liquid crystal display device 500 includes: an insulative substrate (e.g., a glass substrate; not shown); the first TFT 30', the second TFT 40' and the third TFT 50' formed on the insulative substrate; and the scanning lines G1 and G2, the signal line Si and the reference line B connected to the first TFT 30', the second TFT 40' and the third TFT 50'. The TFT substrate further includes the pixel electrode, the storage capacitor electrode 22' and the storage capacitor counter electrode 26'.

The gate electrodes (not shown) of the first TFT 30', the second TFT 40' and the third TFT 50', the scanning lines G1 and G2 and the storage capacitor counter electrode 26' are formed by patterning the same metal layer (e.g., a tantalum layer). Of course, a layered structure including another conductive layer (e.g., a tantalum nitride layer) may alternatively be employed.

Typically, the gate insulating film (e.g., a silicon nitride layer; not shown in FIG. 14) 24' is formed substantially across the entire surface of the TFT substrate so as to cover the gate electrodes of the first TFT 30', the second TFT 40' and the third TFT 50', the scanning lines G1 and G2 and the storage capacitor counter electrode 26'.

Provided on the gate insulating film 24' are: a semiconductor layer (not shown), a source electrode (not shown) and a drain electrode (not shown) forming the first TFT 30', the second TFT 40' and the third TFT 50'; the signal line Si; and the storage capacitor electrode 22'. The source electrode, the drain electrode, the signal line Si and the storage capacitor electrode 22' are formed by patterning the same metal layer (e.g., a tantalum layer). Of course, a layered structure including another conductive layer (e.g., an ITO layer) may alternatively be employed. The storage capacitor electrode 22' is typically formed integrally with the signal line Si. Moreover, a connection line 45 for electrically connecting the drain electrode of the second TFT 40' and the drain electrode of the third TFT 50' to each other is formed by patterning the metal layer described above. The connection line 45 is electrically connected to the storage capacitor counter electrode 26' at a contact hole 9' formed in the gate insulating film 24', and the drain electrodes of the second TFT 40' and the third TFT 50' are electrically connected to the storage capacitor counter electrode 26' via the connection line 45.

Moreover, an insulative layer (e.g., a resin layer; not shown) is formed substantially across the entire surface of the TFT substrate so as to cover these elements, and the pixel electrode (e.g., an aluminum/molybdenum layered film) is formed on the insulative film.

The counter substrate of the liquid crystal display device 500 includes a transparent substrate (e.g., a glass substrate; not shown), a counter electrode (e.g., an ITO layer; not shown) provided on the transparent substrate. The counter electrode may be a single electrode formed substantially across the entire surface of the counter substrate, or a plurality of electrodes arranged in a stripe pattern. Typically, the counter electrode is electrically connected to the reference line B at a common transfer section provided outside the display area, and a counter voltage (reference voltage) is supplied from the reference line B to the counter electrode. The liquid crystal layer 14 provided between the TFT substrate and the counter substrate may be any of various types of liquid crystal layer.

Figure 15:
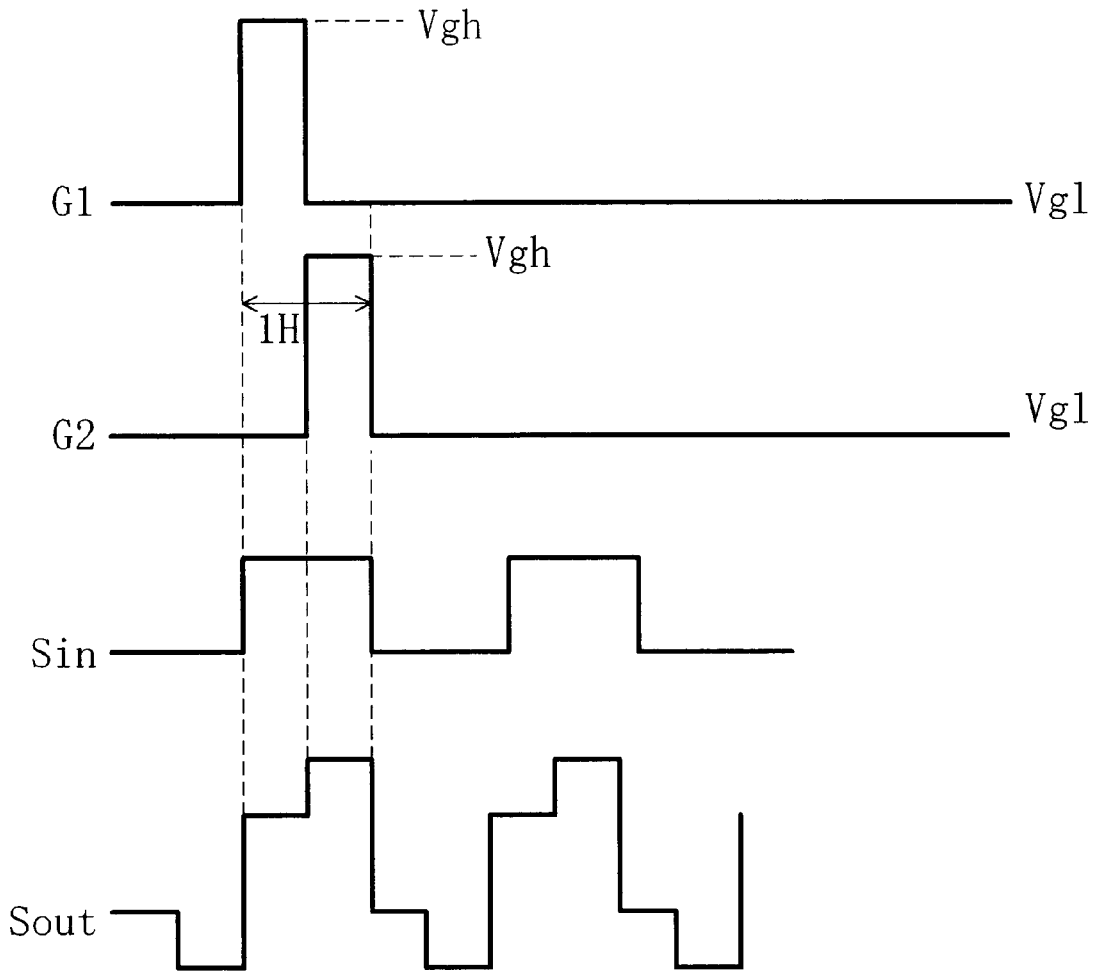
FIG. 15 is a timing chart for driving the liquid crystal display device 500, which is an electronic device according to Embodiment 5 of the present invention.

An operation of the liquid crystal display device 500 having such a configuration will be described with reference to FIG. 15. FIG. 15 is a timing chart for driving the liquid crystal display device 500. In the following description, the operation will be described with respect to the signal line Sn provided in the $n^{th}$ column and each pixel belonging to the $n^{th}$ column. Moreover, for the sake of simplicity, it will be assumed that the electrical connection between the signal line Sn and the pixel electrode of each liquid crystal capacitor belonging to the $n^{th}$ column is turned ON/OFF by the first TFT 30'.

First, the scanning voltage Vgh is supplied from the scanning line G1 to the gate electrodes of the first TFT 30' and the third TFT 50', whereby the electrical connection of the signal line Sn (signal line input section Sin) to the pixel electrode of each liquid crystal capacitor belonging to the $n^{th}$ column and the storage capacitor electrode 22' is ON and the electrical connection between the reference line B and the storage capacitor counter electrode 26' is ON. This results in a state where each liquid crystal capacitor belonging to the $n^{th}$ column and the storage capacitor 20' are electrically connected in parallel to each other. At this time, the voltage Vgl (OFF voltage) lower than the scanning voltage Vgh (ON voltage) is supplied from the scanning line G2 to the gate electrode of the second TFT 40', whereby the electrical connection between the signal line Sn (signal line input section Sin) and the storage capacitor counter electrode 26' is OFF. This state corresponds to the first state illustrated in FIG. 3A. At the same timing as when the scanning voltage Vgh is supplied from the scanning line G1*n*, a predetermined signal voltage is supplied from the signal line Sn to the pixel electrode 12 and the storage capacitor electrode 22', and a predetermined counter voltage (reference voltage) is supplied from the reference line B to the counter electrode 16 and the storage capacitor counter electrode 26', whereby a predetermined voltage (the difference between the signal voltage and the counter voltage) is applied between the pixel electrode 12 and the counter electrode 16 and between the storage capacitor electrode 22' and the storage capacitor counter electrode 26', thus charging each liquid crystal capacitor belonging to the $n^{th}$ column and the storage capacitor 20'.

Then, the voltage Vgl is supplied from the scanning line G1 to the gate electrodes of the first TFT 30' and the third TFT 50', whereby the electrical connection of the signal line input section Sin to the pixel electrode and the storage capacitor electrode 22' is OFF and the electrical connection between the reference line B and the storage capacitor counter electrode 26' is OFF. Moreover, the scanning voltage Vgh is supplied from the scanning line G2 to the gate electrode of the second TFT 40', whereby the electrical connection between the signal line input section Sin and the storage capacitor counter electrode 26' is ON. This results in a state where each of the liquid crystal capacitors belonging to the $n^{th}$ column and the storage capacitor 20' are electrically connected in series with each other. This state corresponds to the state illustrated in FIG. 3B. In this state, a predetermined counter voltage (reference voltage) is supplied from the reference line B to the counter electrode 16 and a predetermined signal voltage is supplied from the signal line Sn to the storage capacitor counter electrode 26', whereby the predetermined voltage applied between the pixel electrode and the counter electrode 16 is increased. At this time, the potential at the signal line output section Sout is higher than the potential at the signal line input section Sin as illustrated in FIG. 15. In the liquid crystal display device 500, the degree of voltage increase is determined by the ratio between the electrostatic capacity of the storage capacitor 20' and the total electrostatic capacity of the liquid crystal capacitors belonging to the same column.

Then, in the liquid crystal display device 500, the increased voltage is held by each liquid crystal capacitor as the electrical connection between the signal line Si (signal line input section Sin) and the pixel electrode is turned OFF by a switching element (e.g., a TFT) provided for each pixel.

As described above, also in the liquid crystal display device 500 of the present embodiment, a voltage higher than the voltage supplied from the external power supply can be applied across the liquid crystal layer 14 provided between the pixel electrode 12 and the counter electrode 16. As a result, the liquid crystal display device 500 can be driven with a relatively low voltage supply from an external power supply, thereby realizing a low voltage driving operation.

Moreover, in the liquid crystal display device 500, the storage capacitors are provided each corresponding to a signal line provided for each column, and a functional block functioning as a booster circuit is provided for each signal line. Employing such a configuration as described above simplifies the structure of a liquid crystal display device and prevents the production process therefor from being complicated, whereby it is possible to easily and efficiently produce a liquid crystal display device capable of operating with a low voltage.

EMBODIMENT 6

Figure 16:
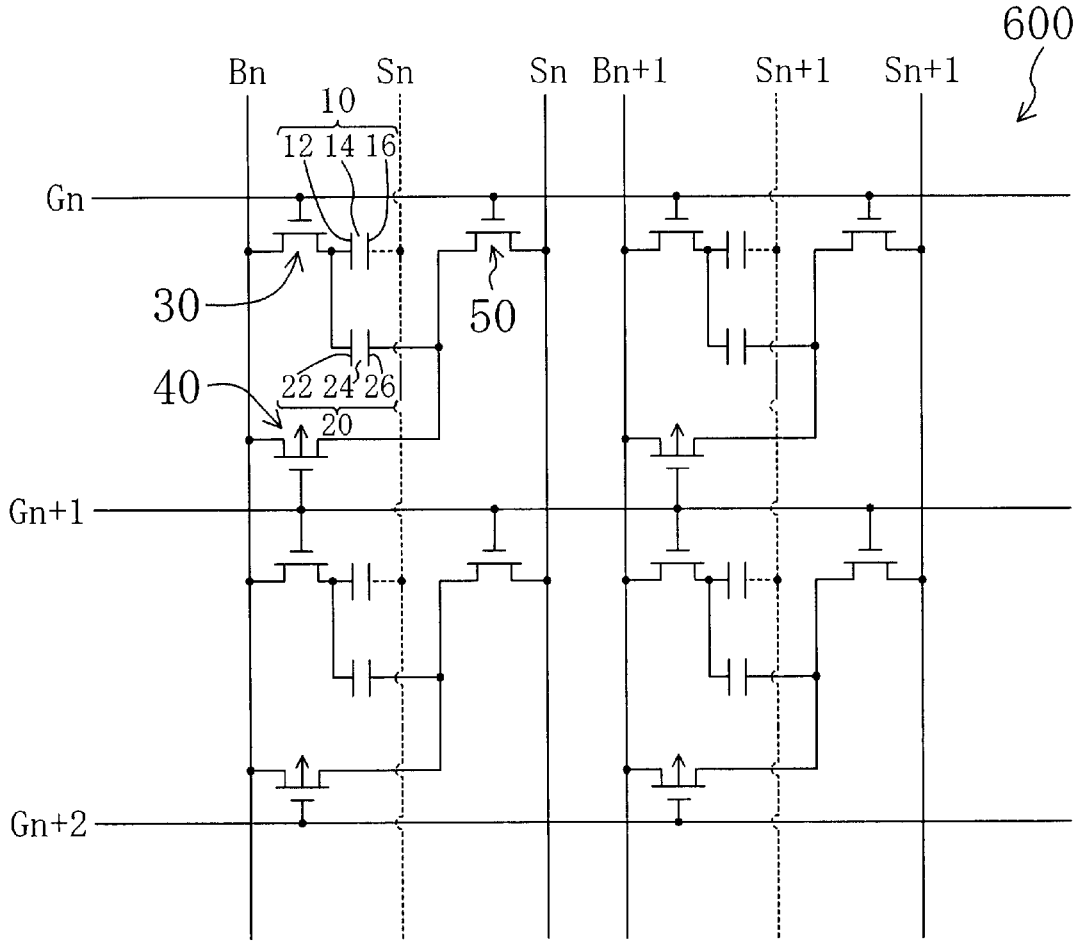
FIG. 16 is a diagram illustrating an equivalent circuit of a liquid crystal display device 600, which is an electronic device according to Embodiment 6 of the present invention.

A liquid crystal display device 600, which is an electronic device according to Embodiment 6 of the present invention, will now be described with reference to FIG. 16 and FIG. 17. FIG. 16 is a diagram illustrating an equivalent circuit of the liquid crystal display device 600, and FIG. 17 is a top view illustrating a portion of the liquid crystal display device 600 corresponding to one pixel.

The liquid crystal display device 600 of Embodiment 6 is similar to the liquid crystal display device 400 of Embodiment 4 but with the conductivity type of the second TFT 40 being different from that of the first TFT 30 and the third TFT 50. In the present embodiment, the second TFT 40 is a p-channel TFT, while the first TFT 30 and the third TFT 50 are n-channel TFTs.

Moreover, while the liquid crystal display devices of Embodiments 1 to 5 include two scanning lines for each row, the liquid crystal display device 600 of Embodiment 6 includes one scanning line Gi for each row (the designation Gi denotes a scanning line provided in the $i^{th}$ row; scanning lines Gn, Gn+1 and Gn+2 that are provided in the nth, $n+1^{th}$ and $n+_2{}^{th}$ rows, respectively, will be shown in the subsequent figures). As illustrated in FIG. 16 and FIG. 17, the gate electrodes of the first TFT 30 and the third TFT 50 of each pixel in the $n^{th}$ row are electrically connected to the scanning line Gn provided in the $n^{th}$ row, and the gate electrode of the second TFT 40 of each pixel in the $n^{th}$ row is electrically connected to the scanning line Gn+1 provided in the $n+1^{th}$ row.

Figure 17:
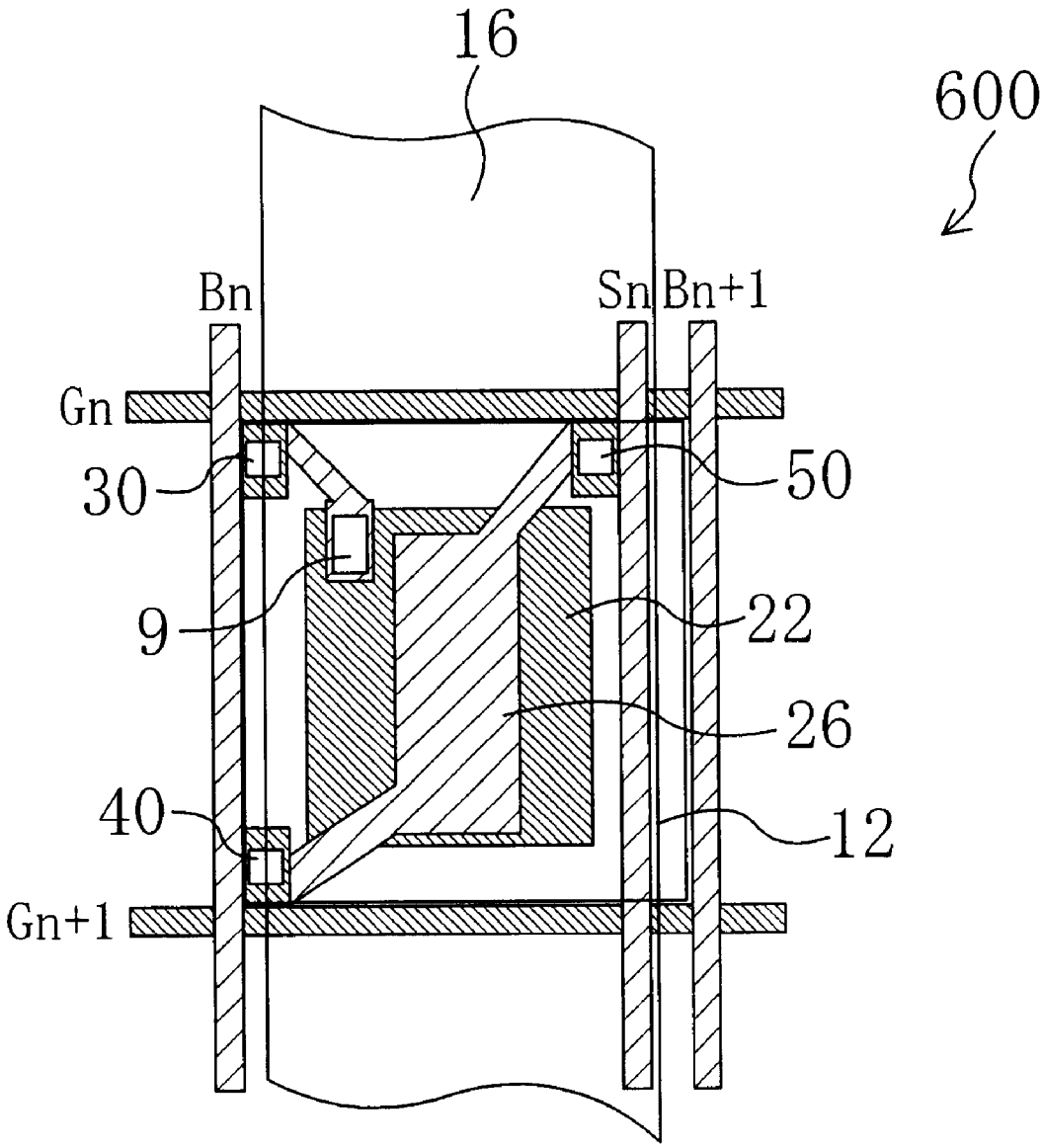
FIG. 17 is a top view schematically illustrating a portion of the liquid crystal display device 600, which is an electronic device according to Embodiment 6 of the present invention, corresponding to one pixel.
Figure 18:
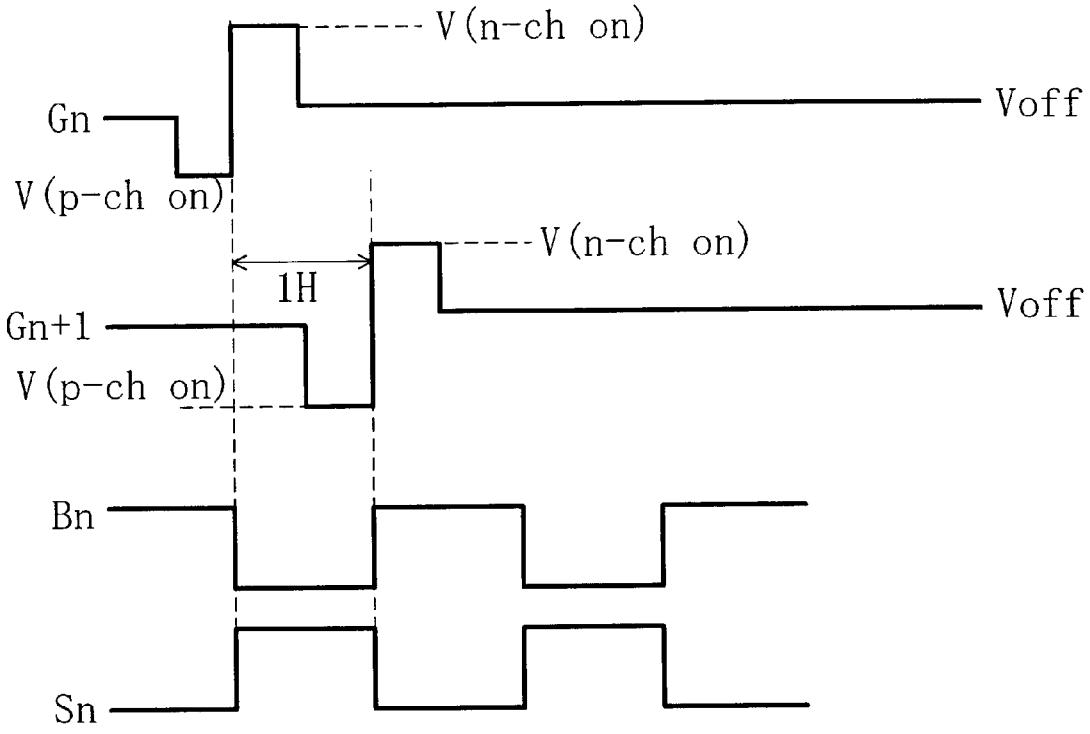
FIG. 18 is a timing chart for driving the liquid crystal display device 600, which is an electronic device according to Embodiment 6 of the present invention, corresponding to one pixel.

The liquid crystal display device 600 of Embodiment 6 illustrated in FIG. 16 and FIG. 17 is driven according to a timing chart as that illustrated in FIG. 18. An operation of the liquid crystal display device 600 will now be described with reference to FIG. 18 with respect to an $n^{th}$ row-$n^{th}$ column pixel.

First, in the first half of 1H, a scanning voltage V (n-ch on) is supplied from the scanning line Gn to the gate electrodes of the first TFT 30 and the third TFT 50, which are n-channel TFTS, whereby the electrical connection of the reference line Bn to the pixel electrode 12 and the storage capacitor electrode 22 is ON, and the electrical connection between the storage capacitor counter electrode 26 and the signal line Sn is ON. This results in a state where the liquid crystal capacitor 10 and the storage capacitor 20 are electrically connected in parallel to each other. At this time, an OFF voltage Voff is supplied from the scanning line Gn+1 to the gate electrode of the second TFT 40, which is a p-channel TFT, whereby the electrical connection between the storage capacitor counter electrode 26 and the reference line Bn is OFF. At the same timing as when the scanning voltage V (n-ch on) is supplied from the scanning line Gn, a predetermined reference voltage is supplied from the reference line Bn to the pixel electrode 12 and the storage capacitor electrode 22 and a predetermined signal voltage is supplied from the signal line Sn to the counter electrode 16 and the storage capacitor counter electrode 26, thus charging the liquid crystal capacitor 10 and the storage capacitor 20.

Next, in the second half of 1H, the OFF voltage Voff is supplied from the scanning line Gn to the gate electrodes of the first TFT 30 and the third TFT 50, whereby the electrical connection of the reference line Bn to the pixel electrode 12 and the storage capacitor electrode 22 is OFF, and the electrical connection between the storage capacitor counter electrode 26 and the signal line Sn is OFF. Moreover, a scanning voltage V (p-ch on) is supplied from the scanning line Gn+1 to the gate electrode of the second TFT 40, whereby the electrical connection between the storage capacitor counter electrode 26 and the reference line Bn is ON. This results in a state where the liquid crystal capacitor 10 and the storage capacitor 20 are electrically connected in series with each other. In this state, a predetermined signal voltage is supplied from the signal line Sn to the counter electrode 16 and a predetermined reference voltage is supplied from the reference line Bn to the storage capacitor counter electrode 26, thus increasing the voltage between the pixel electrode 12 and the counter electrode 16.

Then, as illustrated in FIG. 18, the voltage V (n-ch on) is supplied from the scanning line Gn+1 to the gate electrode of the second TFT 40, whereby the second TFT 40 is OFF and the electrical connection between the storage capacitor counter electrode 26 and the reference line Bn is ON. This results in a state where the storage capacitor counter electrode 26 is electrically cut off, whereby the increased voltage is held by the liquid crystal capacitor 10. At this time, the voltage V (n-ch on) is supplied from the scanning line Gn+1 also to the first TFT 30 and the third TFT 50 of each pixel in the $n+1^{th}$ row.

As described above, in the liquid crystal display device 600 of Embodiment 6, the conductivity type of the second TFT 40 is different from that of the third TFT 50, whereby the signal line Sn+1 for scanning each first TFT 30 and each third TFT 50 in the $n+1^{th}$ row can function also as a scanning line for scanning each second TFT 40 in the $n^{th}$ row. Therefore, the number of scanning lines can be reduced (substantially by half) as compared to the liquid crystal display device 400 of Embodiment 4.

In a liquid crystal display device employing a mounting method in which gate drivers are externally provided, e.g., TAB (Tape Automated Bonding), if the number of scanning lines is reduced, the number of scanning signal inputs and the number of gate driver outputs are also reduced. Therefore, by employing such a configuration as described above, i.e., a configuration in which the conductivity type of the second TFT 40 is different from that of the third TFT 50, it is possible to reduce the cost for the components.

In a liquid crystal display device with a built-in gate driver circuit, if the number of scanning lines is reduced, the area of a region in which a gate driver circuit is formed can be reduced. Therefore, by employing such a configuration as described above, it is possible to reduce the width of the frame.

Moreover, if the number of scanning lines is reduced, the number of intersections between scanning lines and signal lines is reduced, thus reducing the number of capacitors, which are formed at such intersections. Therefore, by employing such a configuration as described above, it is possible to reduce the load of the signal lines (or the reference lines), thereby further reducing the power consumption.

As described above, the present invention provides an electronic device capable of operating with a low voltage, and a method for driving the same.

The present invention is particularly suitable for reducing the power consumption of an active matrix reflection type liquid crystal display device, and provides a liquid crystal display device with a desirably low power consumption. Moreover, with the present invention, the power supply voltage can be lowered, whereby it is possible to use an IC with a lower voltage resistance than in the prior art, or to use a liquid crystal material with a higher threshold voltage than in the prior art.

While the present invention has been described in preferred embodiments, it will be apparent to those skilled in the art that the disclosed invention may be modified in numerous ways and may assume many embodiments other than those specifically set out and described above. Accordingly, it is intended by the appended claims to cover all modifications of the invention that fall within the true spirit and scope of the invention.

What is claimed is:

1. An electronic device, comprising on a substrate:

a plurality of first capacitors arranged in a matrix pattern having rows and columns, each of the first capacitors including a first electrode and a second electrode opposing the first electrode via a first dielectric layer;

a plurality of second capacitors provided so that there is one second capacitor at least for each row or each column, each of the second capacitors including a third electrode electrically connected to the first electrode and a fourth electrode opposing the third electrode via a second dielectric layer;

a first line whose electrical connection to the first electrode and the third electrode is turned ON/OFF by a first switching element;

a second line electrically connected to the second electrode at least temporarily;

a third line whose electrical connection to the fourth electrode is turned ON/OFF by a second switching element; and a fourth line whose electrical connection to the fourth electrode is turned ON/OFF by a third switching element.

2. The electronic device of claim 1, wherein the second switching element and the third switching element are transistors of different conductivity types.

3. The electronic device of claim 1, wherein:

each of the plurality of first capacitors is a liquid crystal capacitor including the first electrode as a pixel electrode, the first dielectric layer as a liquid crystal layer, and the second electrode as a counter electrode opposing the pixel electrode via the liquid crystal layer;

each of the plurality of second capacitors is a storage capacitor including the third electrode as a storage capacitor electrode, the second dielectric layer, and the fourth electrode as a storage capacitor counter electrode opposing the storage capacitor electrode via the second dielectric layer; and the liquid crystal layer modulates light passing therethrough according to a voltage applied between the pixel electrode and the counter electrode.

4. The electronic device of claim 3, wherein the storage capacitor is provided so as to correspond to the liquid crystal capacitor.

5. The electronic device of claim 4, wherein the first line is provided for each row or each column and functions also as the third line so as to supply a signal voltage to the pixel electrode, the storage capacitor electrode and the storage capacitor counter electrode, and the second line is provided for each row or each column and functions also as the fourth line so as to supply a counter voltage to the counter electrode and the storage capacitor counter electrode.

6. The electronic device of claim 5, further comprising a plurality of scanning lines provided so as to cross the first line for supplying a scanning signal to the first switching element, the second switching element and the third switching element.

7. The electronic device of claim 6, wherein every adjacent two of the plurality of scanning lines form a scanning line pair, one of the two scanning lines, which form the scanning line pair, supplying a scanning signal to the first switching element and the third switching element with the other one supplying a scanning signal to the second switching element.

8. The electronic device of claim 2, wherein the first line is provided for each row or each column and functions also as the third line so as to supply a signal voltage to the pixel electrode, the storage capacitor electrode and the storage capacitor counter electrode, the second line supplies a counter voltage to the counter electrode, the fourth line supplies the same voltage as the counter voltage to the storage capacitor counter electrode, and the storage capacitor is provided so as to correspond to the first line.

9. The electronic device of claim 8, further comprising a plurality of scanning lines provided so as to cross the first line for supplying a scanning signal to the first switching element, the second switching element and the third switching element.

10. The electronic device of claim 9, wherein every adjacent two of the plurality of scanning lines form a scanning line pair, one of the two scanning lines, which form the scanning line pair, supplying a scanning signal to the first switching element and the third switching element with the other one supplying a scanning signal to the second switching element.

11. The electronic device of claim 2, further comprising a plurality of additional storage capacitors provided so as to correspond respectively to the plurality of liquid crystal capacitors, each of the additional storage capacitors including an additional storage capacitor electrode electrically connected to the pixel electrode and an additional storage capacitor counter electrode opposing the additional storage capacitor electrode via a third dielectric layer, wherein the third dielectric layer is formed from the same film as the second dielectric layer.

12. A method for driving an electronic device, the electronic device comprising on a substrate:

a plurality of first capacitors arranged in a matrix pattern having rows and columns, each of the first capacitors including a first electrode and a second electrode opposing the first electrode via a first dielectric layer; and a plurality of second capacitors provided so that there is one second capacitor at least for each row or each column, each of the second capacitors including a third electrode and a fourth electrode opposing the third electrode via a second dielectric layer, the method comprising the step of:

switching a state where the first capacitor and the second capacitor are electrically connected in parallel to each other and another state where the first capacitor and the second capacitor are electrically connected in series with each other from one to another, thereby increasing a voltage being applied between the first electrode and the second electrode.

13. The method for driving an electronic device of claim 12, the voltage increasing step further comprising the steps of:

in the state where the first capacitor and the second capacitor are electrically connected in parallel to each other, applying a predetermined first potential to the first electrode and the third electrode while applying a predetermined second potential, which is different from the predetermined first potential, to the second electrode and the fourth electrode, so as to apply a predetermined voltage between the first electrode and the second electrode and between the third electrode and the fourth electrode, thus charging the first capacitor and the second capacitor;

after charging the first capacitor and the second capacitor, achieving a state where the first electrode and the third electrode are electrically connected to each other and the first capacitor and the second capacitor are electrically connected in series with each other, while applying the predetermined second potential to the second electrode and applying the predetermined first potential to the fourth electrode, so as to increase the predetermined voltage applied between the first electrode and the second electrode; and after increasing the predetermined voltage, achieving a state where at least one of the second electrode and the fourth electrode is electrically cut off, whereby the increased voltage is held by the first capacitor.

14. The method for driving an electronic device of claim 12, wherein:

each of the plurality of first capacitors is a liquid crystal capacitor including the first electrode as a pixel electrode, the first dielectric layer as a liquid crystal layer, and the second electrode as a counter electrode opposing the pixel electrode via the liquid crystal layer;

each of the plurality of second capacitors is a storage capacitor including the third electrode as a storage capacitor electrode, the second dielectric layer, and the fourth electrode as a storage capacitor counter electrode opposing the storage capacitor electrode via the second dielectric layer; and the liquid crystal layer modulates light passing therethrough according to a voltage applied between the pixel electrode and the counter electrode.

15. The method for driving an electronic device of claim 14, wherein the storage capacitor is provided so as to correspond to the liquid crystal capacitor.

16. The method for driving an electronic device of claim 14, wherein the storage capacitor is provided for each row or each column.

* * * * *